US007123119B2

(12) United States Patent
Pashby et al.

(10) Patent No.: US 7,123,119 B2
(45) Date of Patent: Oct. 17, 2006

(54) SEALED INTEGRAL MEMS SWITCH

(75) Inventors: Gary Joseph Pashby, Milpitas, CA (US); Timothy G. Slater, Seattle, WA (US)

(73) Assignee: Siverta, Inc., Milpitas, CA (US)

( * ) Notice: Subject to any disclaimer, the term of this patent is extended or adjusted under 35 U.S.C. 154(b) by 55 days.

(21) Appl. No.: 10/523,532

(22) PCT Filed: Aug. 4, 2003

(86) PCT No.: PCT/US03/24255

§ 371 (c)(1),
(2), (4) Date: Feb. 2, 2005

(87) PCT Pub. No.: WO2004/013898

PCT Pub. Date: Feb. 12, 2004

(65) Prior Publication Data

US 2005/0206483 A1 Sep. 22, 2005

(51) Int. Cl.
*H01P 1/10* (2006.01)

(52) U.S. Cl. ..... 333/262; 333/105

(58) Field of Classification Search ..... 333/101, 333/105, 262; 200/181; 335/78
See application file for complete search history.

(56) References Cited

U.S. PATENT DOCUMENTS 5,278,368 A 1/1994 Kasano et al.
5,578,976 A 11/1996 Yao
5,619,061 A 4/1997 Goldsmith et al.
5,648,618 A 7/1997 Neukermans et al.
5,872,496 A 2/1999 Asada
5,895,866 A 4/1999 Neukermans et al.
5,969,465 A 10/1999 Neukermans et al.
5,994,750 A 11/1999 Yagi
6,044,705 A 4/2000 Neukermans et al.
6,069,540 A 5/2000 Berenz et al.
6,272,907 B1 8/2001 Neukermans et al.
6,307,169 B1 10/2001 Sun
6,320,547 B1 * 11/2001 Fathy et al. ..... 343/700 MS
6,384,353 B1 5/2002 Huang
6,392,220 B1 5/2002 Slater et al.
6,410,360 B1 6/2002 Steenberge
6,426,013 B1 7/2002 Neukermans et al.

(Continued)

OTHER PUBLICATIONS

Dooyoung Hah, Euisik Yoon and Songcheol Hong, "A Low Voltage Actuated Micromachined Microwave Switch Using Torison Springs and Leverage," 2000 IEEE MTT-S Digest, pp. 157-160.

(Continued)

*Primary Examiner*—Dean Takaoka
(74) *Attorney, Agent, or Firm*—Donald E. Schreiber

(57) ABSTRACT

A MEMS switch includes a micro-machined monolithic layer (122) having, a seesaw (52), a pair of torsion bars (66*a*, 66*b*), and a frame (64). The frame (64) supports the seesaw (52) for rotation about an axis (68) established by the torsion bars (66*a*, 66*b*). Shorting bars (58*a*, 58*b*) at ends of the seesaw (52) connect across pairs of switch contacts (56*a*1, 56*a*2, 56*b*1, 56*b*2) carried on a substrate (174) bonded to one surface of the layer (122). A base (104) is also joined to a surface of the layer (122) opposite the substrate (174). The substrate (174) carries electrodes (54*a*, 54*b*) for applying forces to the seesaw (52) urging it to rotate about the axis (68). An electrical contact island (152) supported at a free end of a cantilever (166) ensures good electrical conduction between ground plates (162*a*, 162*b*) on the layer (122) and electrical conductors on the substrate (174).

23 Claims, 10 Drawing Sheets

U.S. PATENT DOCUMENTS

| | | | | |
|---|---|---|---|---|
| 6,511,894 | B1 | 1/2003 | Song | |
| 6,535,091 | B1 | 3/2003 | Bechtle et al. | |
| 6,701,779 | B1 | 3/2004 | Volant | |
| 6,734,770 | B1 * | 5/2004 | Aigner et al. | 335/78 |
| 6,791,731 | B1 | 9/2004 | Ryu | |
| 2002/0160583 | A1 | 10/2002 | Song | |

OTHER PUBLICATIONS

Dooyoung Hah, Euisik Yoon and Songcheol Hong, "A Low-Voltage Actuated Micromachined Microwave Switch Using Torison Springs and Leverage," IEEE Transactions on Microwave Theory and Techniques, vol. 48, No. 12, Dec. 2000, pp. 2540-2545.

Dooyoung Hah, Euisik Yoon and Songcheol Hong, "Low Voltage Actuated RF MEMS Switches Using Push-Pull Operation," Extended Abstracts of the 2000 International Conference on Solid State Devices and Materials, Sendai, 2000, pp. 392-393.

Veljko Milanovi, Michel Maharbiz, Angad Singh, Brett Warneke, Ningning Zhou, Helena K. Chan and Kristofer S. J. Pister, "Microrelays for Batch Transfer Integration in RF Systems," 13th Int. IEEE MEMS Conf. Tech. Dig., Miyazaki, Japan, Jan. 23-27, 2000, pp. 787-792.

Veljko Milanovi, Michel Maharbiz and Kristofer S. J. Pister, "Batch Transfer Integration of RF Microrelays," IEEE Microwave and Guided Wave Letters, vol. 10, No. 8, Aug. 2000, pp. 313-315.

* cited by examiner

FIG. 1
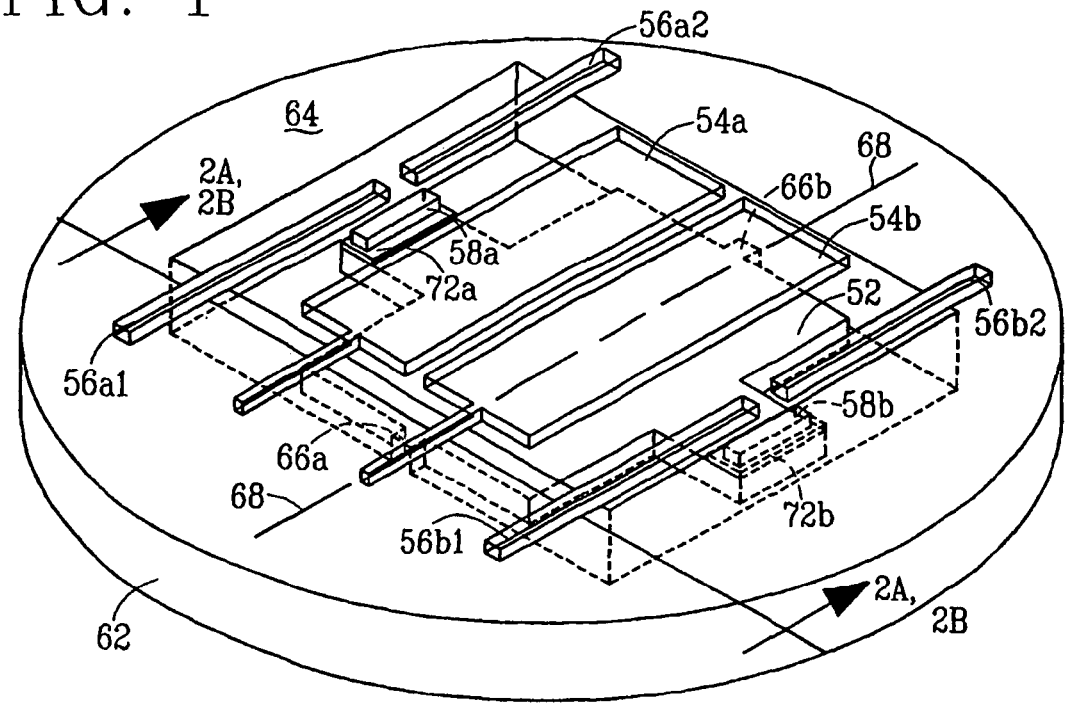
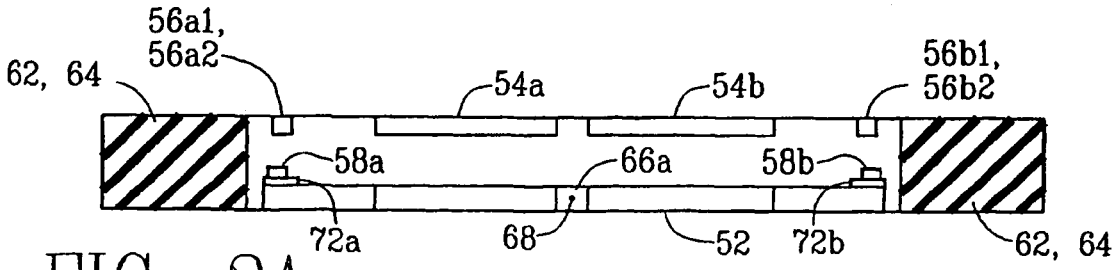
FIG. 2A
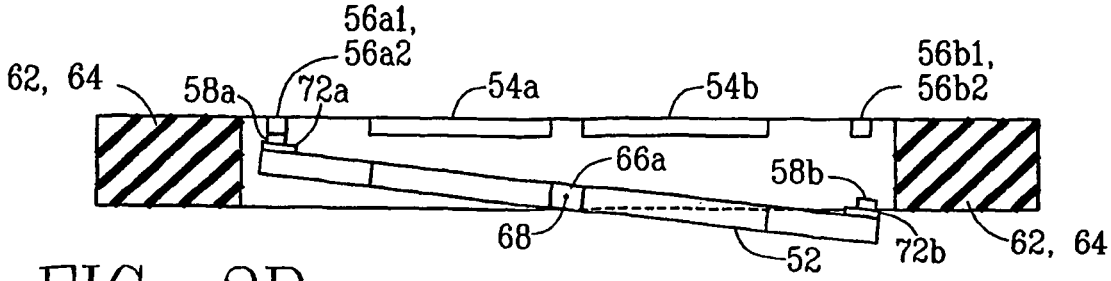
FIG. 2B

SEALED INTEGRAL MEMS SWITCH

The present invention relates generally to the technical field of electrical switches, and, more particularly, to micro-electro mechanical systems ("MEMS") switches.

BACKGROUND ART

Radio frequency ("RF") switches are used widely in microwave and millimeter wave transmission systems for antenna switching applications including beam forming phased array antennas. In general, such switching applications presently use semiconductor solid state electronic switches, such as Gallium Arsenide ("GaAs") MESFETs or PIN diodes, as contrasted with mechanical switches. Such semiconductor solid state electronic switches also are used extensively in cellular telephones for switching between transmitting and receiving.

When RF signal frequency exceeds about 1 GHz, solid state switches suffer from large insertion loss in the "On" state (i.e., when an electrical signal passes through the switch) and poor electrical isolation in the "Off" state (i.e., when the switch blocks transmission of an electrical signal). MEMS switches offer distinct advantages over solid-state devices in both of these characteristics, particularly for RF frequencies near or exceeding 1 GHz.

U.S. Pat. Nos. 5,994,750, 6,069,540 and 6,535,091 all disclose MEMS switches in which a pair of coaxial torsion bars, a pin or a pair of flexible hinges support respectively substantially planar and rigid beams or a vane for rotation about an axis established by the torsion bars, pin or flexible hinges. In all three patents, the pair of coaxial torsion bars, the pin or the pair of flexible hinges respectively support the substantially planar and rigid beams or vane a small distance above a substrate. U.S. Pat. No. 5,994,750 ("the '750 patent") discloses that ends of the torsion bars projecting outward from the beam and anchored respectively to a pair of support members alone support the beam the small distance above the glass substrate. Both U.S. Pat. No. 6,069,540 ("the '540 patent") and U.S. Pat. No. 6,535,091 ("the '091 patent") interpose respectively the pin or an upper and lower fulcrum located at the flexible hinges between the beam or vane and the substrate to maintain a spacing therebetween.

In the instance of the '750 patent, the beam extends to only one side of the torsion bars so its rotation thereabout in closing an electrical switch provided thereby is equivalent to the movement of a door swinging on its hinges. Alternatively, both in the '540 and '091 patents the respective beam or vane extends in both directions outward from the pin or pair of flexible hinges. Thus in the structures respectively disclosed in these two patents, in closing an electrical switch the beam's or vane's rotation about the axis established by the pin or pair of flexible hinges resembles the movement of a seesaw. In all three patents, electrostatic attraction induces rotation which effects switch closure.

Omitting numerous fabrication details which appear in the text and drawings of the '750 patent, it discloses in a first example that material forming its beam initially begins as part of a monolithic p-type silicon substrate which carries an n-type diffusion layer into which boron ions are injected to form a $p^+$ surface layer. That is, the n-type diffusion layer separates the $p^+$ surface layer from the p-type silicon substrate. During the beam's fabrication, etching removes the p-type silicon substrate leaving only material of the n-type diffusion layer and $p^+$ surface layer to form the beam. Similarly, torsion bar fabrication removes material of the n-type diffusion layer leaving only material of $p^+$ surface layer to form the torsion bars. Subsequent processing forms aluminum support members spanning between the $p^+$ surface layer material forming the torsion bar ends and the adjacent glass substrate.

The '540 patent discloses that to reduce switch insertion loss as well as improve sensitivity, its beam is preferably formed from entirely of metal as is the pin about which the beam rotates. In particular, the '540 patent discloses that the beam may be formed from nickel ("Ni") electroplated at low temperatures compared to most semiconductor processing. The '540 patent discloses that not only does its all metal beam reduce insertion losses relative to known $SiO_2$ or composite silicon metal beams, such a configuration also improves the third order intercept point for providing increased dynamic range. Electrical potentials applied respectively between a pair of gold electrodes deposited on one side of the glass substrate nearest to the metallic beam and a pair of field plates disposed on the opposite side of the glass substrate furthest from the beam generate the electrostatic force which effects rotation of the beam about the metallic pin.

The vane included in the MEMS switch disclosed in the '091 patent is formed of relatively inflexible material, such as plated metal, evaporated metal, or dielectric material on top of a metal seed layer. Thin flexible metal hinges connect opposite sides of the vane to a gold frame which projects outward from the low-loss microwave insulating or semi-insulating substrate. The substrate may be fabricated from quartz, alumina, sapphire, Low Temperature Ceramic Circuit on Metal ("LTCC-M"), GaAs or high-resistivity silicon. Configured in this way, the vane and the hinges are disposed above the substrate, and the flexible hinges electrically couple the vane to the frame. The hinges, which can be flat or corrugated, allow the vane to rotate about a pivot axis that is parallel to the substrate and above the lower fulcrum. Pull-back and pull-down electrodes, which can be encapsulated with an insulator such as silicon nitride ($Si_3N_4$), are formed on the substrate adjacent to the vane. Electrical potentials applied either to the pull-down or the pull-back electrodes respectively close or open the MEMS switch.

A series of U.S. Pat. Nos. 5,629,790, 5,648,618, 5,895,866, 5,969,465, 6,044,705, 6,272,907, 6,392,220 and 6,426,013 all disclose MEMS structured which are reminiscent to a greater or lesser extent to those described above for the '750, '540 and '091 patents. These patents all disclose an integrated, micromachined torsional scanner, which in a particular configuration, may include a frame-shaped reference member. A particular configuration of the torsional scanner includes a pair of diametrically opposed, axially aligned torsion bars that are coupled to and project from the reference member. In a particular configuration, a plate-shaped dynamic member, analogous to the beams and vane disclosed respectively in the '750, '540 and '091 patents, is encircled by the frame and is coupled thereto by the torsion bars. Configured in this way, the torsion bars support the dynamic member for rotation about an axis that is collinear with the torsion bars. The reference member, the torsion bars and the dynamic member are all monolithically fabricated from a semiconductor layer of a silicon substrate. A desirable method for fabricating the torsional scanner uses a Simox wafer, or similar wafers, e.g. a silicon-on-insulator ("SOI") substrate, where the thickness of the plate is determined by an epitaxial layer of the wafer. As compared to metals or polysilicon, single crystal silicon is preferred both for the plate and for the torsion bars because of its superior strength and fatigue characteristics. These patents also disclose using electrostatic force to effect rotary motion of the dynamic member.

DISCLOSURE OF INVENTION

An object of the present invention is to provide an improved MEMS switch.

Another object of the present invention is to provide a MEMS switch that switches swiftly.

Another object of the present invention is to provide a MEMS switch having a lower operating voltage.

Another object of the present invention is to provide a single-pole double-throw ("SPDT") MEMS switch.

Another object of the present invention is to provide a MEMS switch which by routine structural repetition can provide additional poles.

Another object of the present invention is to provide a MEMS switch that provides improved signal isolation.

Another object of the present invention is to provide a MEMS switch which facilitates switch contact material selection and customization.

Another object of the present invention is to provide a MEMS switch whose manufacture does not require a sacrificial layer.

Another object of the present invention is to provide a MEMS switch that facilitates bulk manufacture, and divides facilely into individual MEMS switches.

Another object of the present invention is to provide a MEMS switch that inherently becomes hermetically sealed during fabrication.

Another object of the present invention is to provide a MEMS switch which is simpler.

Another object of the present invention is to provide a MEMS switch that is cost effective.

Another object of the present invention is to provide a MEMS switch that is easy to manufacture.

Another object of the present invention is to provide a MEMS switch that is economical to manufacture.

Another object of the present invention is to provide a MEMS structure which provides a good electrical connection between metal present on two different layers of the MEMS structure.

Briefly, a first aspect of the present invention is an integral MEMS switch that is adapted for selectively coupling an electrical signal present on a first input conductor connected to the MEMS switch to a first output conductor also connected to the MEMS switch. The MEMS switch includes a micro-machined monolithic layer of material having:

a. a seesaw;
b. a pair of torsion bars that are disposed on opposite sides of and coupled to the seesaw, and which establish an axis about which the seesaw is rotatable; and
c. a frame to which ends of the torsion bars furthest from the seesaw are coupled.

The frame supports the seesaw through the torsion bars for rotation about the axis established by the torsion bars. The MEMS switch also includes an electrically conductive shorting bar carried at an end of the seesaw that is located away from the rotation axis established by the torsion bars.

The MEMS switch also includes a base that is joined to a first surface of the monolithic layer. A substrate, also included in the MEMS switch, is bonded to a second surface of the monolithic layer that is located away from the first surface thereof to which the base is joined. Formed in the substrate are an electrode which is juxtaposed with a surface of the seesaw that is located to one side of the rotation axis established by the torsion bars. Upon application of an electrical potential between the electrode and the seesaw, the seesaw is urged to rotate in a first direction about the rotation axis established by the torsion bars. Also formed on the substrate are a pair of switch contacts that are adapted to be connected respectively to the input conductor and to the output conductor. The pair of switch contacts:

a. are disposed adjacent to but spaced apart from the first shorting bar when no force is applied to the seesaw;
b. are electrically insulated from each other when no force is applied to the seesaw; and
c. upon application of a sufficiently strong force to the seesaw which urges the seesaw to rotate in the first direction, are contacted by the first shorting bar.

In this way, contact between the shorting bar and the switch contacts electrically couples together the first pair of switch contacts.

Another aspect of the present invention is a MEMS electrical contact structure and a MEMS structure which includes a first and a second layer each of which respectively carries an electrical conductor. The second layer also includes a cantilever which supports an electrical contact island at a free end of the cantilever. The electrical contact island has an end which is distal from the cantilever, and which carries a portion of the electrical conductor that is disposed on the second layer. In this particular aspect of the present invention the portion of the electrical conductor at the end of the electrical contact island is urged by force supplied by the cantilever into intimate contact with the electrical conductor that is disposed on the first layer.

These and other features, objects and advantages will be understood or apparent to those of ordinary skill in the art from the following detailed description of the preferred embodiment as illustrated in the various drawing figures.

BRIEF DESCRIPTION OF DRAWINGS

FIG. 1 is a perspective view of a seesaw, electrodes, switch contacts, and shorting bars that are included in MEMS switches in accordance with the present invention;

FIGS. 2A and 2B are alternative elevational views of the seesaw, electrodes, electrodes, switch contacts, and shorting bars taken along the line 2A,2B—2A,2B in FIG. 1;

BEST MODE FOR CARRYING OUT THE INVENTION

Figure 3:
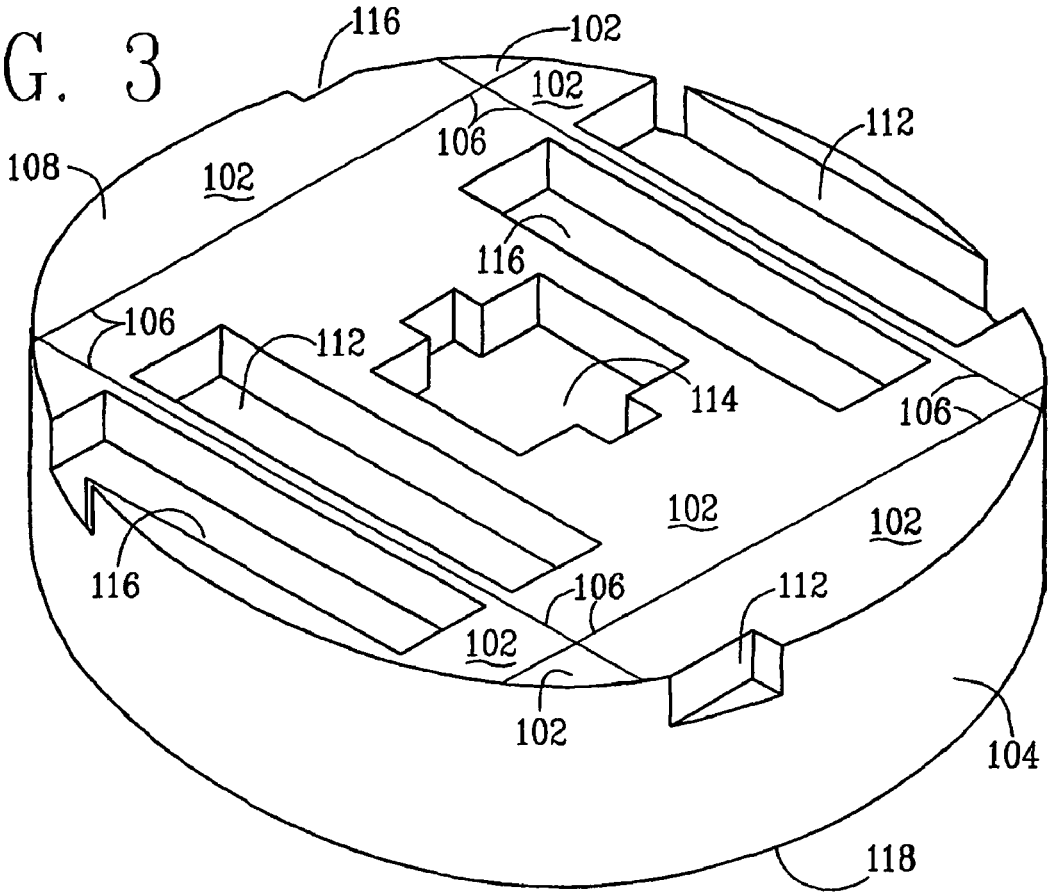
FIG. 3 is a perspective view of an area on a surface of a base wafer included in the MEMS switch into which micro-machined cavities have been formed in accordance with a preferred embodiment of the present invention.

FIGS. 1, 2A and 2B illustrate a seesaw 52, metallic electrodes 54*a* and 54*b*, metallic switch contacts 56*a*1, 56*a*2, 56*b*1 and 56*b*2, and metallic shorting bars 58*a* and 58*b* that are included in MEMS switches of the present invention. The seesaw 52 is formed by micro-machining a layer 62 of material, preferably single crystal silicon (Si). Material of the layer 62 also forms a frame 64 which preferably surrounds the seesaw 52. A pair of torsion bars 66*a* and 66*b*, which are depicted by dashed lines in FIG. 1 and which extend outward from opposite sides of the seesaw 52 to the frame 64, are also formed monolithically with the seesaw 52 and the frame 64 from the material of the layer 62. While dimensions of the seesaw 52 vary depending upon a particular configuration for the MEMS switch, in one illustrative embodiment the aperture micro-machined into the layer 62 to establish the frame 64 which surrounds the seesaw 52 measures approximately about 0.4×0.4 millimeters. In this same illustrative embodiment, the layer 62 is approximately 17 microns thick, while the seesaw 52 is approximately 5 microns thick as are the torsion bars 66*a* and 66*b*.

The torsion bars 66*a* and 66*b* support the seesaw 52 from the surrounding frame 64 for rotation about an axis 68 which is collinear with the torsion bars 66*a* and 66*b*. The shorting bars 58*a* and 58*b*, which are several microns thick, are carried by the seesaw 52 at opposite ends thereof which are furthest from the axis 68. The torsion bars 66*a* and 66*b* are approximately 20 microns wide and 60 microns long in the previously mentioned illustrative embodiment. The torsion bars 66*a* and 66*b* having this configuration are stiff and therefore exhibit a high resonant frequency, and provide a very large restoring force which reduces the likelihood that MEMS switches will exhibit stiction. Furthermore, stiffness of the torsion bars 66*a* and 66*b* is directly related to switching speed with a higher the resonant frequency for the combined seesaw 52 and torsion bars 66*a* and 66*b* increasing the switching speed.

For the illustrative embodiment described above, several microns of gold (Au) plated onto a thin titanium (Ti) adhesion layer forms the shorting bars 58*a* and 58*b*. The shorting bars 58*a* and 58*b* are approximately 10 microns wide, and 40 microns long. A pair of silicon dioxide ($SiO_2$) insulating pads 72*a* and 72*b*, respectively located at opposite ends of the seesaw 52 furthest from the axis 68, are interposed between the shorting bars 58*a* and 58*b* and the seesaw 52 to electrically insulate the shorting bars 58*a* and 58*b* therefrom. As depicted in FIG. 1, the 72*b*insulating pads 72*a* and 72*b* cover a larger area on the seesaw 52 than the shorting bars 58*a* and 58*b* and are approximately 1.0 micron thick. The electrodes 54*a* and 54*b* and the switch contacts 56*a*1, 56*a*2, 56*b*1 and 56*b*2 adjacent to the seesaw 52 are approximately 4.0 microns thick.

When there is no external force applied to the seesaw 52, the restoring force supplied by the torsion bars 66*a* and 66*b* disposes the seesaw 52 in the position illustrated in FIG. 2A. Disposed in this position, a distance of approximately 3 microns separates the seesaw 52 from the adjacent electrodes 54*a* and 54*b* and switch contacts 56*a*1, 56*a*2, 56*b*1 and 56*b*2. Applying an electrical potential between the layer 62 and one of the electrodes 54*a* and 54*b* causes the seesaw 52 to rotate about the axis 68 due to the attraction of the seesaw 52 toward that electrode, e.g. electrode 54*a* in FIG. 2B. Sufficient rotation of the seesaw 52 causes one of the shorting bars 58*a* and 58*b* to contact a pair of the switch contacts 56*a*1 and 56*a*2, or 56*b*1 and 56*b*2, e.g. switch contacts 56*a*1 and 56*a*2 in FIG. 2B, to establish an electrical circuit there between.

While as described below there exist various different processes for assembling a MEMS switch in accordance with the present invention having the seesaw 52, electrodes 54*a* and 54*b*, switch contacts 56*a*1, 56*a*2, 56*b*1 and 56*b*2, and shorting bars 58*a* and 58*b* configured as illustrated in FIGS. 1, 2A and 2B, a preferred process begins as depicted in FIG. 3. FIG. 3 depicts an area 102 occupied by a single MEMS switch on a base wafer 104. In the illustration of FIG. 3, lines 106 indicate boundaries of the central area 102 with eight (8) identical, adjacent areas 102 which, except adjacent to edges of the base wafer 104, surround the central area 102. In accordance with the following description, after the MEMS switch has been completely fabricated, the areas 102 will be separated into those of individual MEMS switches by sawing along the lines 106.

The base wafer 104 is a conventional silicon wafer which may be thinner than a standard SEMI thickness for its diameter. For example, if the base wafer 104 has a diameter of 150 mm, then a standard SEMI wafer usually has a thickness of approximately 650 microns. However, the thickness of the base wafer 104, which can vary greatly and still be usable for fabricating a MEMS switch in accordance with the present invention, may be thinner than a standard SEMI silicon wafer.

Fabrication of the preferred embodiment of a MEMS switch in accordance with the present invention begins first with micro-machining a switched-terminals pad cavity 112, a seesaw cavity 114 and a common-terminal pad cavity 116 into a top surface 108 of the base wafer 104. The depth of the cavities 112, 114 and 116 is not critical, but should be approximately 10 microns deep for the illustrative embodiment described above. A plasma system, preferably a Reactive Ion Etch ("RIE") that will provide good uniformity and anisotropy, is used in micro-machining the cavities 112, 114 and 116. However, KOH or other wet etches may also be used to micro-machine the cavities 112, 114 and 116. A standard etch blocking technique is used in micro-machining the cavities 112, 114 and 116, i.e. either photo-resist for plasma etching or a mask formed either by silicon oxide or silicon nitride for a wet, KOH etch. This micro-machining produces the seesaw cavity 114 which accommodates movement of the seesaw 52 such as that illustrated in FIG. 2B, while the cavities 112 and 116 as described in greater detail below accommodate feedthroughs or electrical contact pads.

After the cavities 112, 114 and 116 have been micro-machined into the top surface 108, the next step, not illustrated in any of the FIGS., is etching alignment marks into a bottom surface 118 of the base wafer 104 depicted in FIG. 3. The bottom side alignment marks must register with the cavities 112, 114 and 116 micro-machined into the base wafer 104 to permit aligning other structures micro-machined during subsequent processing operations with the cavities 112, 114 and 116. These bottom side alignment marks will also be used during a bottom side silicon etch near the end of the entire process flow. The bottom side alignment marks are established first by a lithography step using a special target-only-mask, aligned with the cavities 112, 114 and 116, and then by micro-machining the bottom surface 118 of the base wafer 104. The pattern of the target-only-mask is plasma etched a few microns deep into the bottom surface 118 before removing photo-resist from both surfaces of the base wafer 104. Creating bottom side alignment marks can be omitted if an aligner having infrared capabilities is available for use in fabricating MEMS switches.

Figure 4:
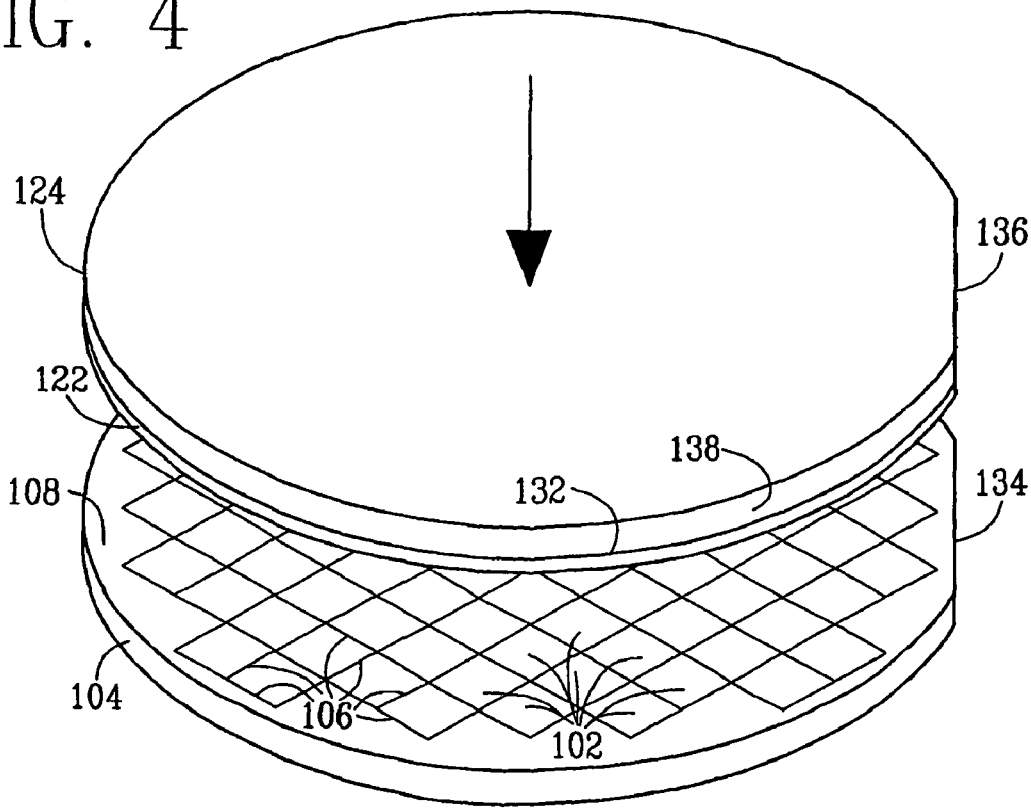
FIG. 4 is a perspective view illustrating fusion bonding of a device layer of an SOI wafer onto a top surface of the base wafer into which cavities have been micro-machined.

The next step in fabricating the MEMS switch, depicted in FIG. 4, is fusion bonding a thin, single crystal Si device layer 122 of a silicon-on-insulator ("SOI") wafer 124 to the top surface 108 of the base wafer 104. Preferably the device layer 122 of the SOI wafer 124 is 17 microns thick over an extremely thin buried layer of silicon dioxide ($SiO_2$), thus its name Silicon on Insulator or SOI. A characteristic of the SOI wafer 124 which is advantageous in micro-machining the seesaw 52 and the torsion bars 66*a* and 66*b* is that the device layer 122 has an essentially uniform thickness, preferably about 17 microns, over the entire surface of the SOI wafer 124 with respect to the thin $SiO_2$ layer 132. In fusion bonding the device layer 122 of the SOI wafer 124 to the top surface 108 of the base wafer 104, the wafers 104 and 124 are aligned globally by matching an alignment flat 134 on the base wafer 104 with a corresponding alignment flat 136 on the SOI wafer 124. Fusion bonding of the SOI wafer 124 to the base wafer 104 is performed at approximately 1000° C.

Figure 5:
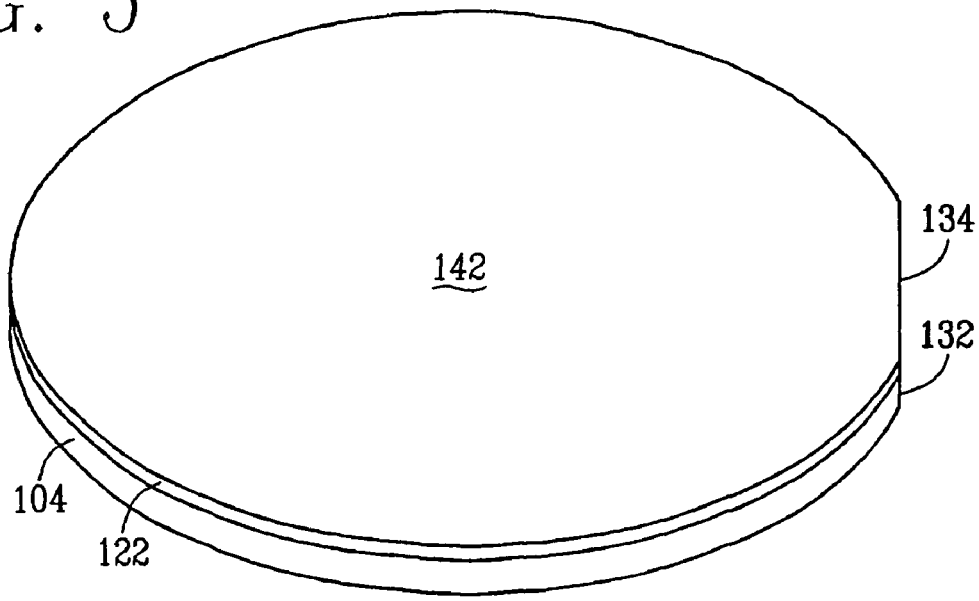
FIG. 5 is a perspective view of the device layer of the SOI wafer fusion bonded onto the top surface of the base wafer after removal of the SOI wafer's handle layer and buried $SiO_2$ layer.

After the base wafer 104 and the SOI wafer 124 have been formed into a single piece by fusion bonding, a handle layer 138 located furthest from the device layer 122 and then the $SiO_2$ layer 132 are removed leaving only the device layer 122 bonded to the top surface 108 of the base wafer 104. First a protective silicon dioxide layer, a silicon nitride layer, a combination of both, or any other suitable protective layer is formed on the bottom surface 118 of the base wafer 104. Having thus masked the base wafer 104, the silicon of the handle layer 138 is removed using a KOH etch applied to the SOI wafer 124. Upon reaching the buried $SiO_2$ layer 132 after the bulk of the silicon forming the handle layer 138 has been removed, the rate at which the KOH etches the SOI wafer 124 slows appreciably. In this way, the $SiO_2$ layer 132 functions as an etch stop for removing the handle layer 138. After the bulk silicon of the handle layer 138 has been removed, the formerly buried but now exposed $SiO_2$ layer 132 is removed using a HF etch. Note that other methods of removing the bulk silicon of the handle layer 138 may be used including other wet silicon etchants, a plasma etch, grinding and polishing, or a combination of methods. After completing this process only the device layer 122 of the SOI wafer 124 remains bonded to the base wafer 104 as illustrated in FIG. 5.

Figure 6:
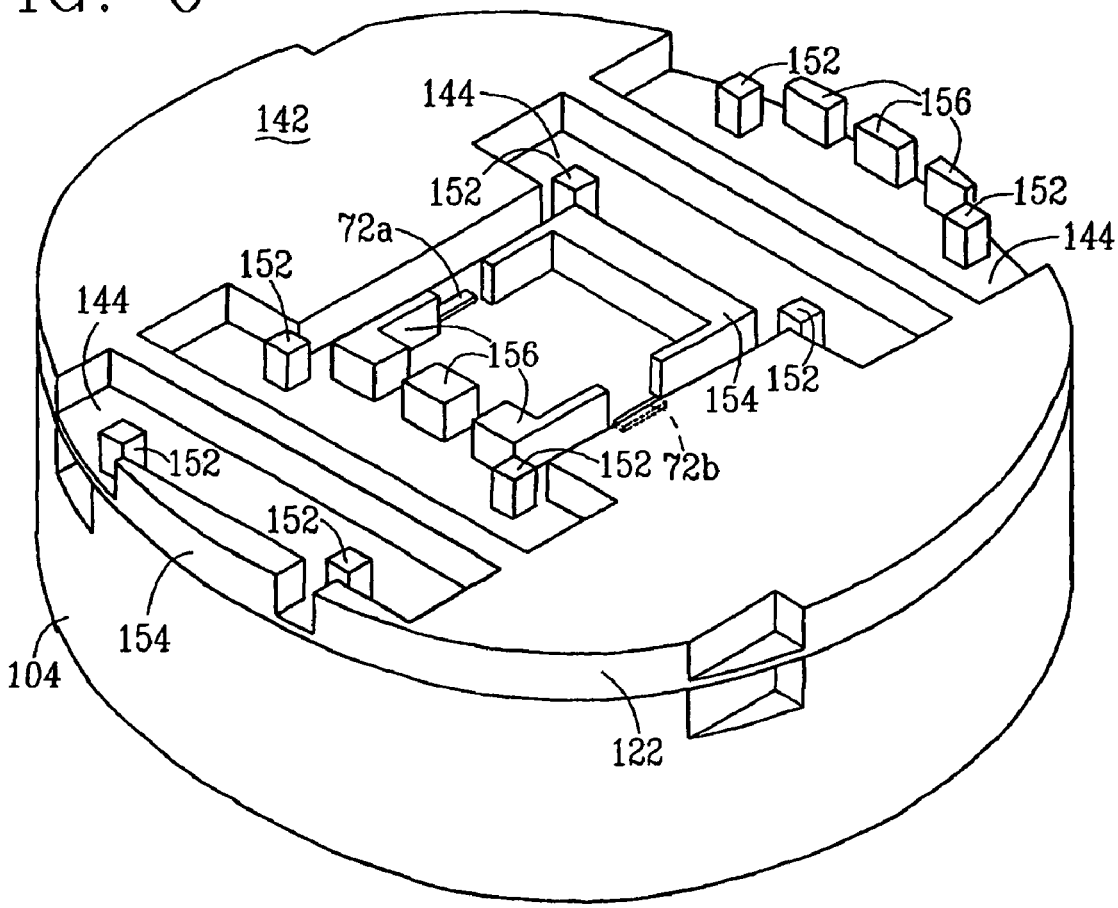
FIG. 6 is a perspective view of a portion of the device layer of the SOI wafer fusion bonded onto the top surface of the base wafer that is located immediately over the area of the base wafer depicted in FIG. 3 after formation of an initial cavity therein and deposition and patterning of an electrically insulating $SiO_2$ layer.

FIG. 6 depicts what has been exposed as a front surface 142 of device layer 122 due to etching away of the handle layer 138 and the $SiO_2$ layer 132. Similar to forming the cavities 112, 114 and 116, the next step in fabricating the preferred embodiment of the MEMS switch is micro-machining, preferably using a KOH etch, an approximately 12.0 micron deep initial cavity 144 through the front surface 142 into the device layer 122. As is well known to those skilled in the art of MEMS and semiconductor fabrication, the front surface 142 of the device layer 122 is first oxidized and patterned to provide a blocking mask for micro-machining the initial cavity 144 using KOH. The oxide on the front surface 142 of the device layer 122 remaining after micro-machining the initial cavity 144 is then removed. While the illustration of FIG. 6 et seq. depict the walls of the initial cavity 144 as being vertical, because they are preferably formed using a KOH etch rather than a RIE plasma etch, as is well known in the art the walls of the initial cavity 144 in the preferred embodiment actually slope at an angle of approximately 54°.

In the preferred embodiment of the MEMS switch, the depth of the initial cavity 144 establishes a spacing between surfaces of the electrodes 54*a* and 54*b*, illustrated in FIG. 2A, that are furthest from the seesaw 52, and a surface of the seesaw 52 nearest to the electrodes 54*a* and 54*b*. The depth of the initial cavity 144 is calculated to provide the desired gap between the shorting bars 58*a* and 58*b* on the seesaw 52 and the metal of the electrodes 54*a* and 54*b* and the switch contacts 56*a*1, 56*a*2, 56*b*1 and 56*b*2 taking into consideration the desired thickness of the seesaw 52 and of the thin device layer 122.

Micro-machining the initial cavity 144 into the device layer 122 leaves four (4) grounding islands 152 projecting upward from a floor of the initial cavity 144, a U-Shaped wall 154 and also a serrated U-shaped wall 156. The grounding islands 152 and the walls 154 and 156 extend upward from a floor of the initial cavity 144 to the front surface 142 of the device layer 122. The walls 154 and 156 mainly surround an area of the floor of the front surface 142 which is to become the seesaw 52 of the MEMS switch. After forming the initial cavity 144, the $SiO_2$ insulating pads 72*a* and 72*b* are deposited onto the floor of the initial cavity 144 in preparation for depositing the shorting bars 58*a* and 58*b* and other metallic structures within the initial cavity 144.

Figure 7:
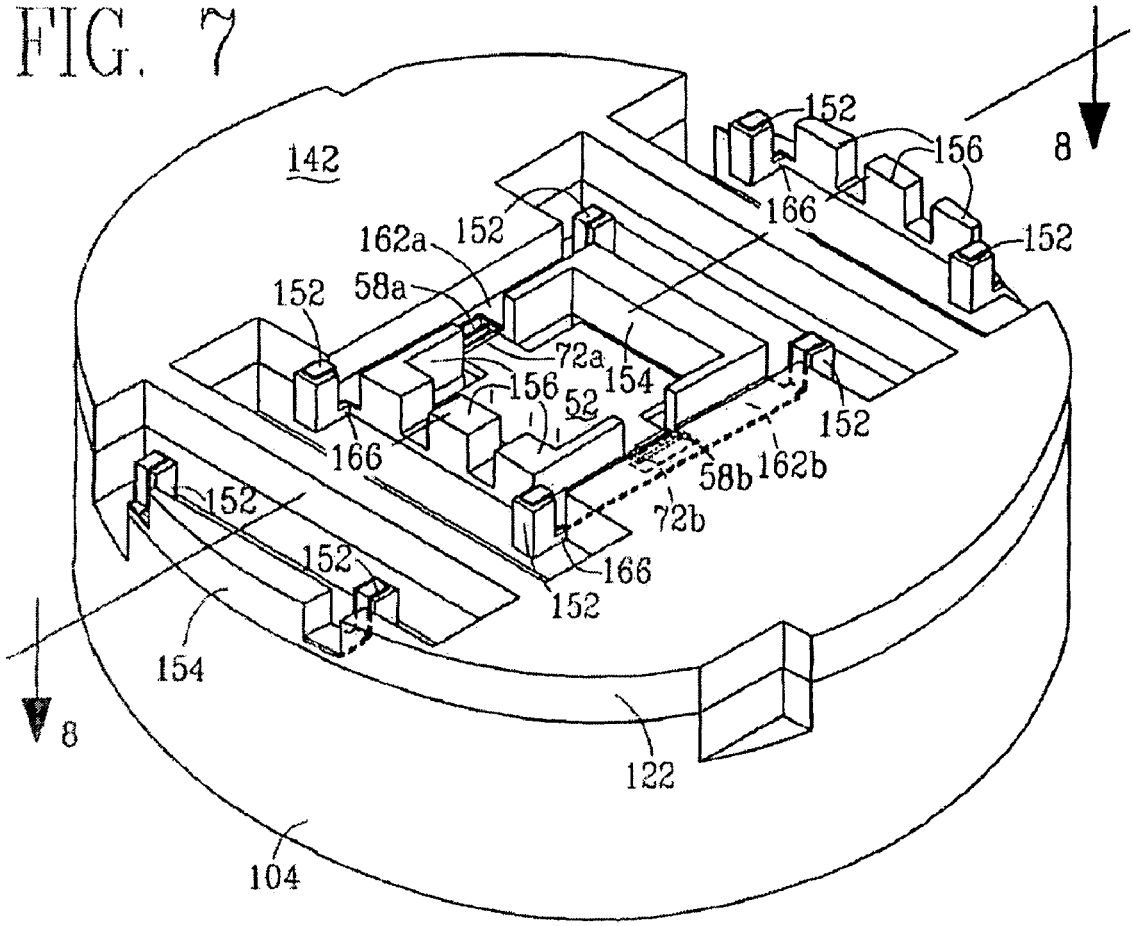
FIG. 7 is another perspective view of a portion of the device layer of the SOI wafer fusion bonded onto the top surface of the base wafer illustrated in FIG. 6 after deposition of metallic structures in the initial cavity and formation of the seesaw and its supporting torsion bars.
Figure 8:
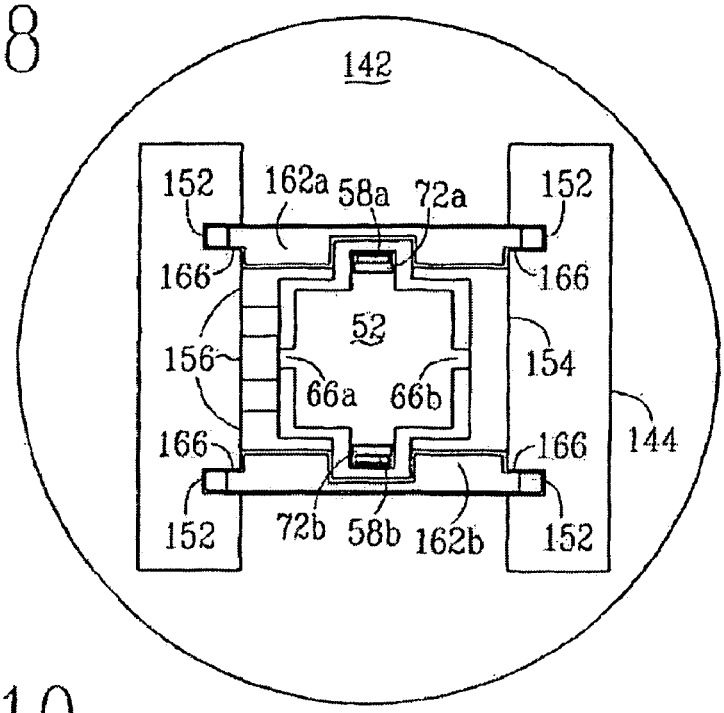
FIG. 8 is a plan view of the central portion of the initial cavity taken along the line 8—8 in FIG. 7 showing the metallic structures, the seesaw and its supporting torsion bars which are located there.

FIGS. 7 and 8 depict various metallic structures, including the shorting bars 58*a* and 58*b*, which are deposited on the floor of the initial cavity 144. As stated previously, these metallic structures are preferably formed by first depositing a thin Ti adhesion layer onto which is then deposited, the illustrative embodiment, approximately 0.5 microns of Au. In addition to the shorting bars 58*a* and 58*b*, a pair of metallic ground plates 162*a* and 162*b* respectively extend across the initial cavity 144 past the shorting bars 58*a* and 58*b* and insulating pads 72*a* and 72*b* between pairs of grounding islands 152. After depositing the 0.5 micron Au layer, the metal is then lithographically patterned and etched to establish shapes for the shorting bars 58*a* and 58*b* and the ground plates 162*a* and 162*b*. Subsequently, additional Au is plated onto the shorting bars 58*a* and 58*b* for a total thickness of approximately 4.0 microns.

After all the metallic structures have been formed in the initial cavity 144, a second RIE etch, which pierces material of the device layer 122 remaining at the floor of the initial cavity 144, outlines the torsion bars 66*a* and 66*b* and the seesaw 52 thereby freeing the seesaw 52 for rotation about the axis 68. In this way the seesaw 52 and torsion bars 66*a* and 66*b* are formed monolithically with the surrounding material of the device layer 122 which becomes the frame 64. The second RIE etch also opens the initial cavity 144 to the cavities 112 and 116 in the base wafer 104 leaving cantilevers 166 beneath and supporting each of the grounding islands 152. Supporting each grounding island 152 at a free end of a cantilever 166 accommodates the thickness of the Au at the ends of the ground plates 162*a* and 162*b* atop each grounding island 152 which projects above the front surface 142. Compliant force supplied by the cantilever 166 ensures formation of a good electrical contact between the ground plates 162*a* and 162*b* and subsequent metalization layers described below.

Figure 9:
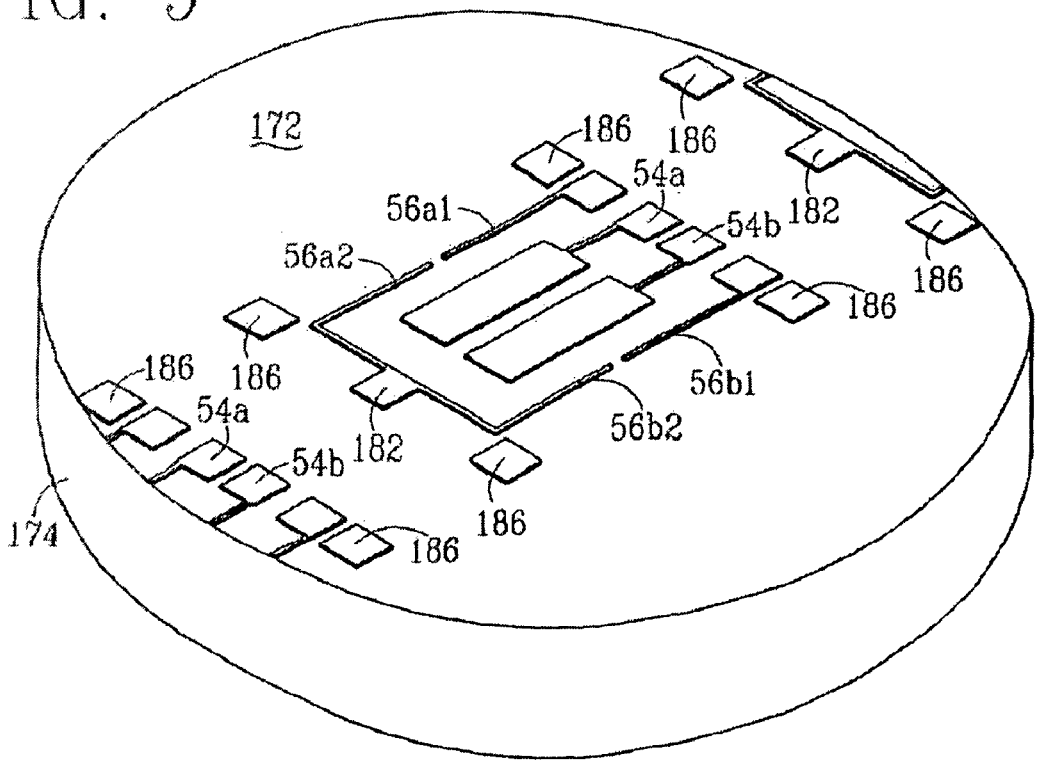
FIG. 9 is a perspective view of a portion of a glass substrate to be mated with the area of the device layer depicted in FIG. 7 which illustrates metal structures micro-machined thereon.

FIG. 9 depicts an area on a metalization surface 172 of a Pyrex glass substrate 174 which subsequently will be mated with and fused to the front surface 142 of the device layer 122 depicted in FIG. 7. The glass substrate 174 has the same diameter as the base wafer 104 and SOI wafer 124, and preferably is 1.0 mm thick. The illustration of FIG. 9 depicts metal structures present atop the metalization surface 172 after depositing a thin 1000 A° seed layer of chrome-gold (Cr—Au) onto the metalization surface 172. Patterning of the Cr—Au seed layer establishes contact pads and conductor lines for what will become a common terminal 182 of the preferred embodiment MEMS switch, the switch contacts 56*a*1, 56*a*2, 56*b*1 and 56*b*2, and the electrodes 54*a* and 54*b*. Patterning of the Cr—Au seed layer also establishes grounding pads 186 that are adapted for mating with and engaging that portion of the ground plates 162*a* and 162*b* which is present on projecting ends of the grounding islands 152. After patterns have been established in the Cr—Au seed layer for these structures, approximately 2.0 microns of Au is then plated to form the patterns which appear in FIG. 9. Preferably the switch contacts 56*a*1, 56*a*2, 56*b*1 and 56*b*2 and the common terminal 182 are 4.0 micron thick to satisfy skin effect requirements associated with efficiently conducting high frequency radio frequency ("RF") signals. However, a switch in accordance with the present invention may use materials and processing procedures which differ from those described above.

The electrodes 54*a* and 54*b* are plated to the same thickness as the switch contacts 56*a*1, 56*a*2, 56*b*1 and 56*b*2 to reduce the gap between the electrodes 54*a* and 54*b* and immediately adjacent areas on the seesaw 52. A smaller gap between the electrodes 54*a* and 54*b* and immediately adjacent areas on the seesaw 52 reduces voltage which must be applied to actuate the MEMS switch.

Figure 10:
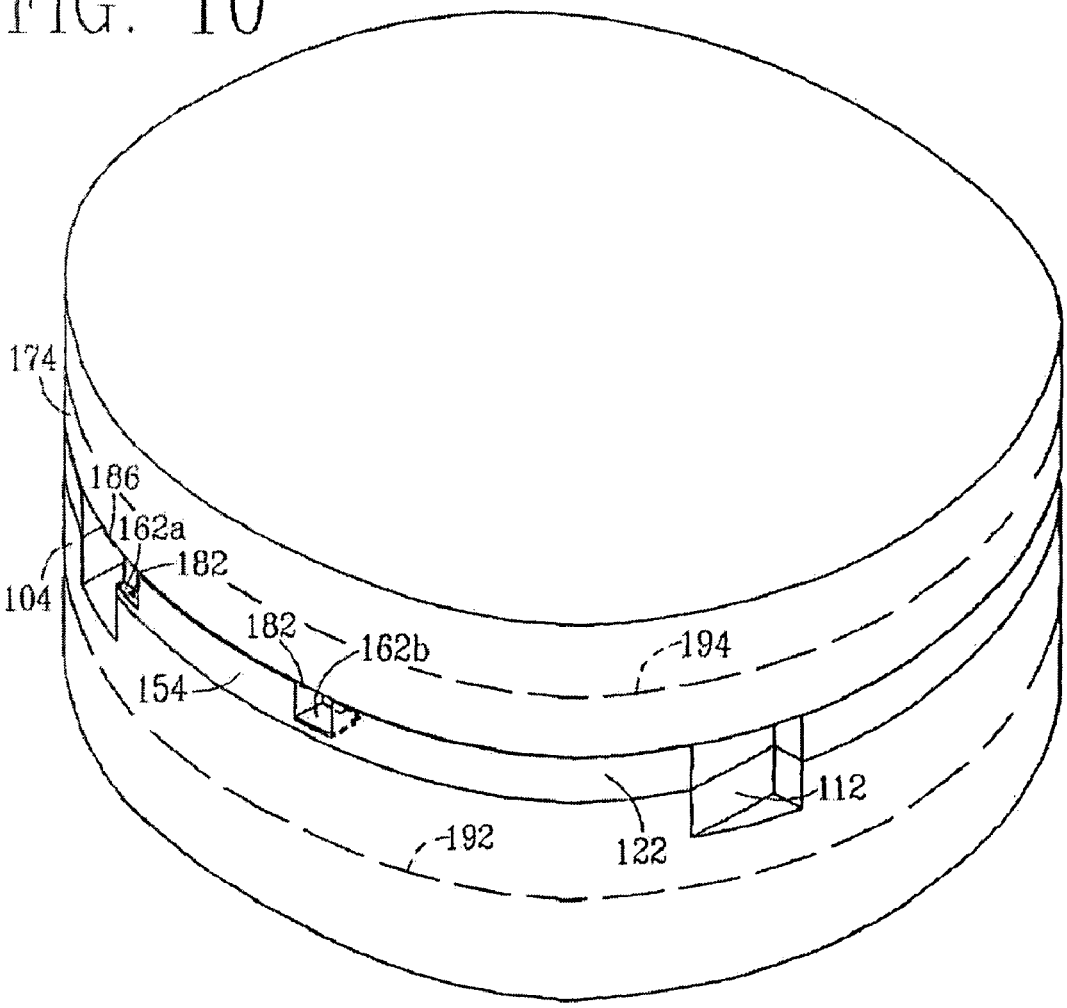
FIG. 10 is a perspective view of portions of the base wafer, the device layer of the SOI wafer, and the glass substrate depicted in FIG. 9 after the metallic structures on the glass substrate have been mated with the micro-machined surface of the device layer depicted in FIG. 7, and the device layer has been anodically bonded thereto.

FIG. 10 depicts the area of the base wafer 104, illustrated progressively in FIGS. 3, 6 and 7, after the corresponding area of the metalization surface 172 of the glass substrate 174, illustrated in FIG. 9, has been anodically bonded to the front surface 142 of the device layer 122. In bonding the metalization surface 172 to the front surface 142, the metal pattern depicted in FIG. 9 is carefully aligned with the structure micro-machined into the device layer 122 that appears in FIGS. 7 and 8. Bonding of the metalization surface 172 to the front surface 142 in this way establishes the MEMS switch as illustrated in FIGS. 1, 2A and 2B. In the structure depicted in FIGS. 7 and 8, the wires of the electrodes 54*a* and 54*b* connecting to the contact pads thereof respectively pass through the serrations in the wall 156 while the switch contacts 56*a*1, 56*a*2, 56*b*1 and 56*b*2 respectively pass along arms of the U-shaped walls 154 and 156 in close proximity respectively to the ground plates 162*a* and 162*b*.

During anodic bonding of the metalization surface 172 to the 174, the cantilevers 166 supporting the grounding islands 152 deflect due to interference between the metal of the ground plates 162*a* and 162*b* that is atop each grounding island 152 and of the grounding pads 186 formed on the metalization surface 172 of the glass substrate 174. Mechanical stiffness of the single crystal silicon material forming the cantilevers 166 provides forces which ensure a sound electrical connection between the grounding pads 186 and the portions of the ground plates 162*a* and 162*b* juxtaposed therewith at the grounding islands 152.

After the glass substrate 174 has been anodically bonded to the wall 154, the entire outer portions both of the base wafer 104 and of the glass substrate 174 furthest from the device layer 122 are thinned as indicated by dashed lines 192 and 194 in FIG. 10. Preferably, the base wafer 104 and of the glass substrate 174 are thinned in a double side grinding and polishing operation. About half the thickness of each layer is removed with the glass substrate 174 having a final thickness of approximately 100 microns. Grinding and polishing of the combined base wafer 104, device layer 122 and glass substrate 174 yields MEMS switches having a thickness comparable to that of standard semiconductor devices. Any techniques commonly used in MEMs or semiconductor processing, including grinding, polishing, chemical mechanical planarization ("CMP"), or various wet or plasma etches, may be used in thinning the base wafer 104 and the glass substrate 174.

Figure 11:
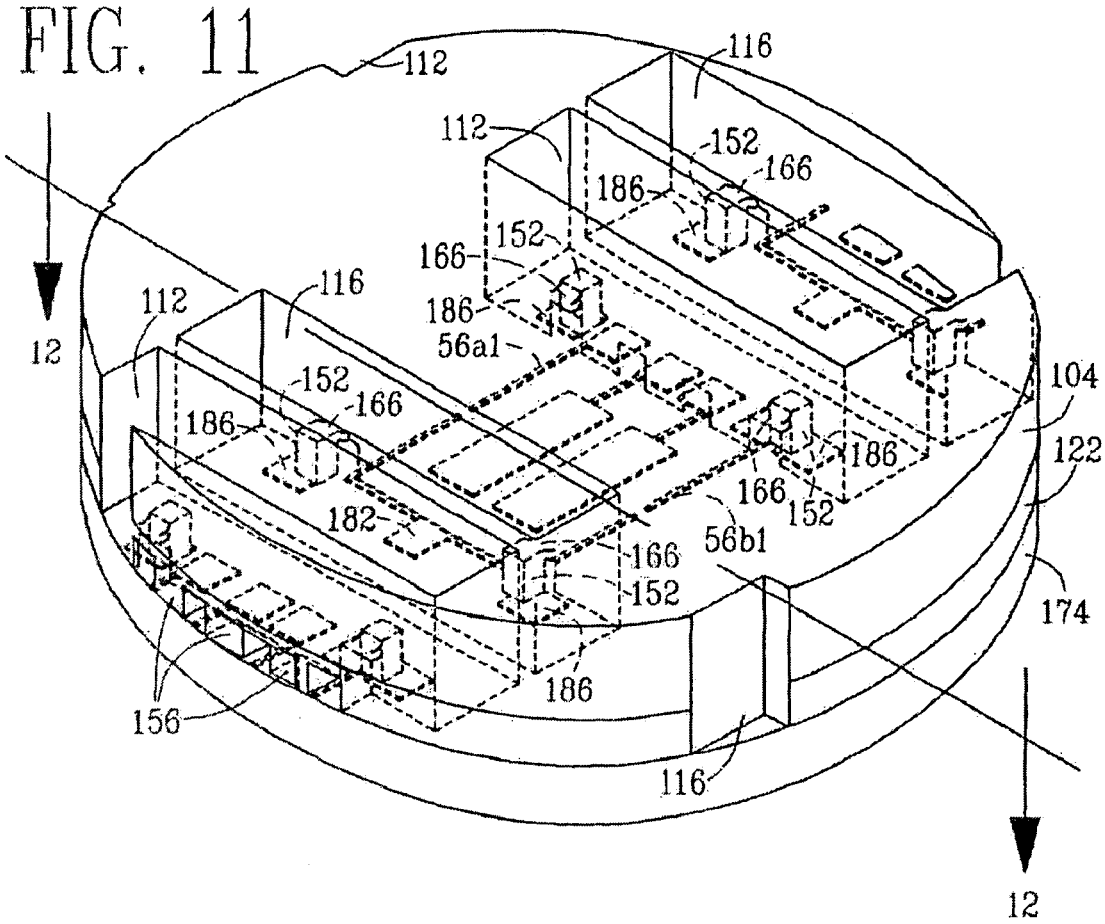
FIG. 11 is a perspective view of a portion of the basic wafer, device layer and glass substrate depicted in FIG. 10 after the basic wafer and glass substrate have been thinned, and after micro-machining apertures through the basic wafer there by exposing contact pads and grounding pads that are included among the micro-machined metallic structures depicted in FIG. 7.

FIG. 11 depicts the section of the combined base wafer 104, device layer 122 and glass substrate 174 inverted from the illustration of FIG. 10. FIG. 11 also illustrate apertures etched through silicon material of the base wafer 104 which before etching remained at the base of the cavities 112 and 116 after thinning the base wafer 104. Extending the cavities 112 and 116 is performed by first establishing a pattern on the bottom side of the base wafer 104 furthest from the device layer 122 using a double-side aligner and viewing the structure of the device layer 122 through the transparent glass substrate 174. Then the silicon material forming the base wafer 104 is plasma etched using a deep RIE system. Opening the cavities 112 and 116 in this way exposes the contact pads for the electrodes 54*a* and 54*b*, the switch contacts 56*a*1 and 56*b*1 together with the common terminal 182 for switch contacts 56*a*2 and 56*b*2, and the grounding pads 186, depicted in FIG. 9 and by dashed lines in FIG. 11, that were initially formed on the glass substrate 174 prior to anodic bonding.

Figure 12:
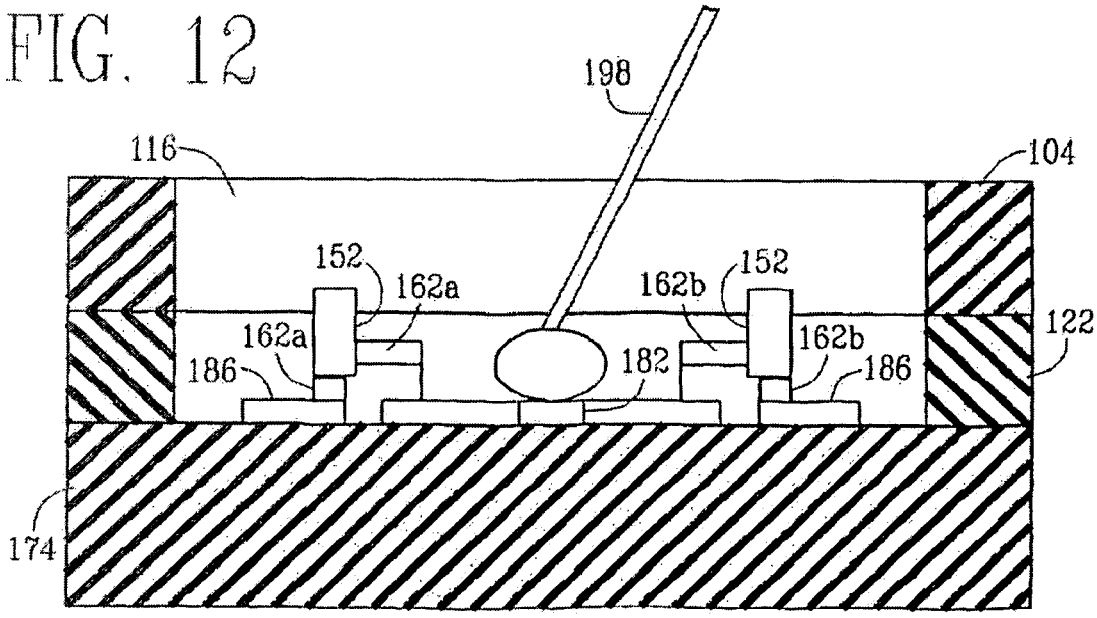
FIG. 12 is a cross-sectional, elevational view taken along the line 12—12 in FIG. 11 illustrating wire bonding an electrical lead to one of the several contact pads included in the MEMS switch.

FIG. 12 is a cross-sectional view of a MEMS switch in accordance with the present invention after sawing of the combined base wafer 104, device layer 122 and glass substrate 174 to individualize the many switches concurrently fabricated therein, and after wire bonding electrical leads 198 to contact pads and grounding pads 186 included in the MEMS switch, only one of which electrical leads 198 appears in FIG. 12.

The electrical leads 198 provides a means for coupling two input signals into the MEMS switch one of which is output therefrom, or alternatively coupling a single input signal to either one or the other of two outputs from the MEMS switch. The electrical leads 198 also provides means for electrically grounding the ground plates 162*a* and 162*b* together with the seesaw 52, and for establishing a difference in electrical potential between the seesaw 52 and the electrodes 54*a* and 54*b* which urge the seesaw 52 to rotate about the axis 68.

Sawing the combined base wafer 104, device layer 122 and glass substrate 174 produces individual MEMS switches which typically are approximately 2.0×1.5×1.5 millimeters (L×W×H). These dimensions can easily vary to be twice as large or one-half that size. During sawing of the combined base wafer 104, device layer 122 and glass substrate 174, open cavities 112 and 116 on the surface of the base wafer 104 which face upward are covered by conventional wafer tape. Sealing the cavities 112 and 116 with the wafer tape is important to insure the saw slurry does not enter into the cavities 112 and 116 where contact pads and grounding pads 186 are exposed at bases thereof, and, perhaps, even to the shorting bars 58*a* and 58*b* and switch contacts 56*a*1, 56*a*2, 56*b*1 and 56*b*2 at the interior of the MEMS switch.

If necessary or advantageous, a barrier to intrusion of the saw slurry into the interior of the MEMS switch may also be established by making surfaces of the device layer 122 depicted in FIG. 7 and the glass substrate 174 depicted in FIG. 9 hydrophobic. Passages between the cavities 112 and 116 and the interior of the MEMS switch where the shorting bars 58*a* and 58*b* and switch contacts 56*a*1, 56*a*2, 56*b*1 and 56*b*2 established during anodic bonding of the glass substrate 174 to the device layer 122 are approximately 10 microns by 100 microns. If surfaces of these passages are hydrophobic, that surface condition will bar intrusion of water during sawing. Making these surfaces hydrophobic is accomplished by coating the surfaces with silicone before anodically bonding the metalization surface 172 of the glass substrate 174 thereto, or after etching the backside of the base wafer 104 as described above to open the cavities 112 and 116. One method that maybe used for coating the surfaces with silicone involves placing the combined base wafer 104 and device layer 122 depicted in FIG. 7 or the combined base wafer 104, device layer 122 and glass substrate 174 depicted in FIG. 11 into a vacuum chamber with a heated pad of Gel Pak material. A hot plate is used to heat a layer of polymer from the Gel Pak pad to approximately 40° C. After the hot plate has reached this temperature, the chamber containing the combined base wafer 104 and device layer 122 and the Gel Pak pad is sealed, evacuated and left in that state for approximately 4 hours. After that interval of time, the chamber is first purged then backfilled with air and then the combined base wafer 104 and device layer 122 removed for subsequent processing. Processing the combined base wafer 104 and device layer 122 in this way prevents water from entering the interior of the MEMS switch through the cavities 112 and 116 during sawing.

Figure 13:
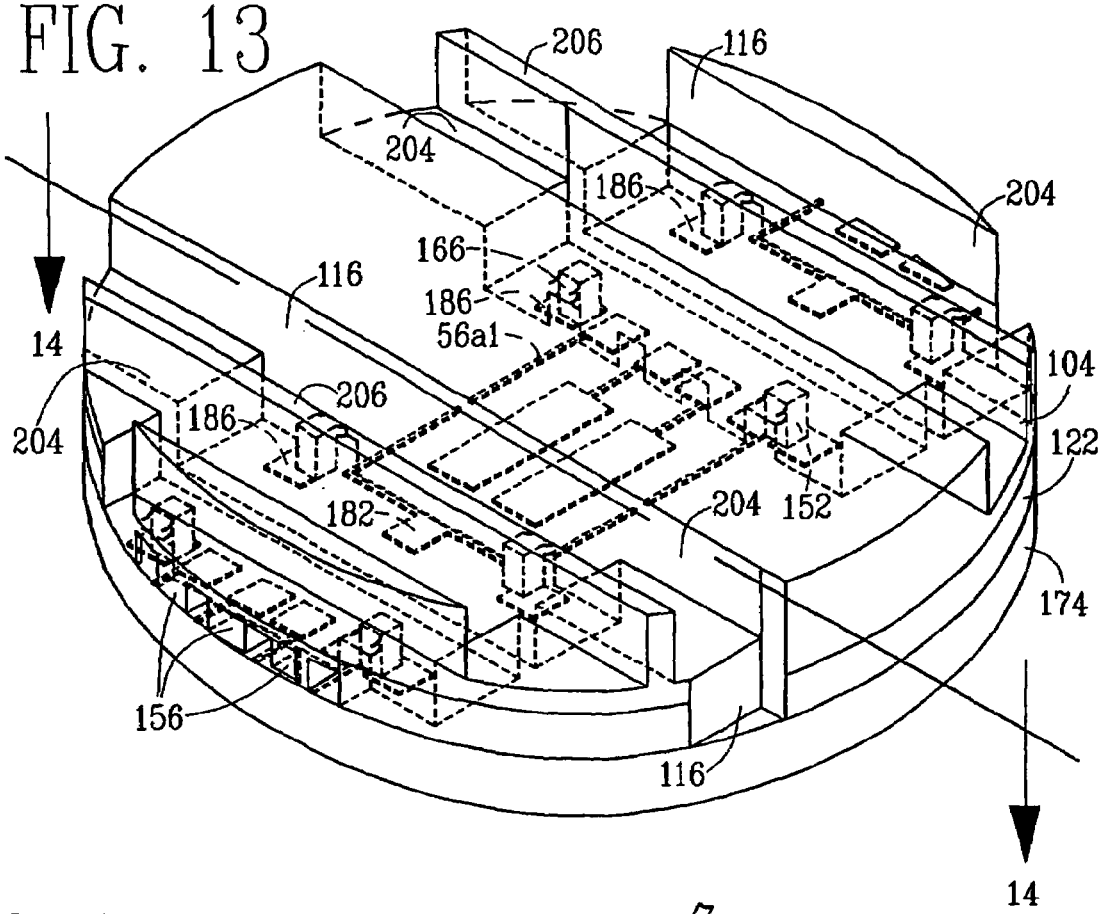
FIG. 13 is a perspective view of a portion of the basic wafer, device layer and glass substrate depicted in FIGS. 10 and 11 after the basic wafer and glass substrate have been thinned, and after sawing the basic wafer there by exposing contact pads and grounding pads that are included among the micro-machined metallic structures depicted in FIG. 7.
Figure 14:
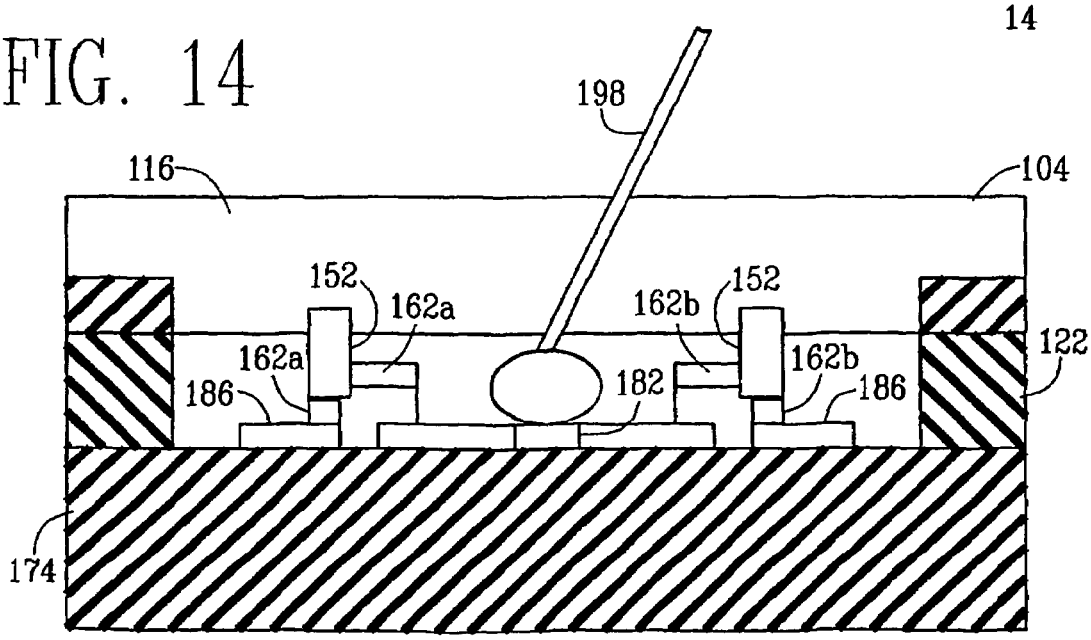
FIG. 14 is a cross-sectional, elevational view taken along the line 14—14 in FIG. 13 illustrating wire bonding an electrical lead to one of the several contact pads included in the MEMS switch.

Alternative embodiments of the present invention mainly involve different techniques for making electrical connections to the switch contacts 56*a*1, 56*a*2, 56*b*1 and 56*b*2, electrodes 54*a* and 54*b*, and ground plates 162*a* and 162*b*. One alternative technique for providing these connections illustrated in FIGS. 13 and 14 machines saw cuts 204 along rows of cavities 112 and 116 into but not through the base wafer 104, rather than RIE etching, for opening the cavities 112 and 116. Depending upon the spacing between immediately adjacent MEMS switches in the combined base wafer 104, device layer 122 and glass substrate 174 and upon the width of the saw blade, machining the saw cuts 204 may, or may not, leave a projecting ridge 206 between immediately adjacent pairs of saw cuts 204. Subsequent sawing completely through the combined base wafer 104, device layer 122 and glass substrate 174 to form individual MEMS switches removes the ridge 206, if one remains. Because machining the saw cuts 204 necessarily exposes the contact and grounding pads to saw slurry, for this particular alternative embodiment it is essential that the passages between the cavities 112 and 116 and the interior of the MEMS switch be made hydrophobic before anodically bonding the glass substrate 174 to the device layer 122. Preferably these surfaces are rendered hydrophobic using the Gel Pak procedure described above.

Figure 15:
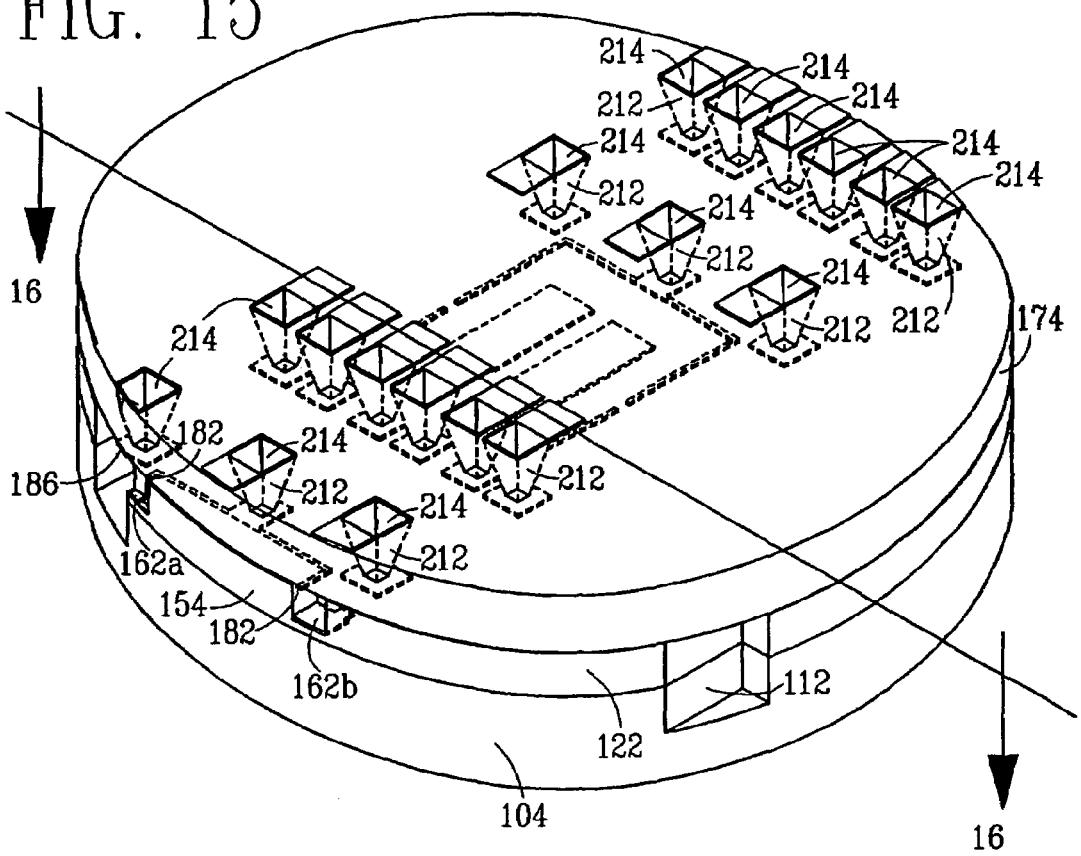
FIG. 15 is a perspective view of a portion of the basic wafer, device layer and glass substrate depicted in FIG. 10 after the basic wafer and glass substrate have been thinned for another alternative embodiment of the present invention in which electrically conductive vias are formed through the glass substrate.
Figure 16:
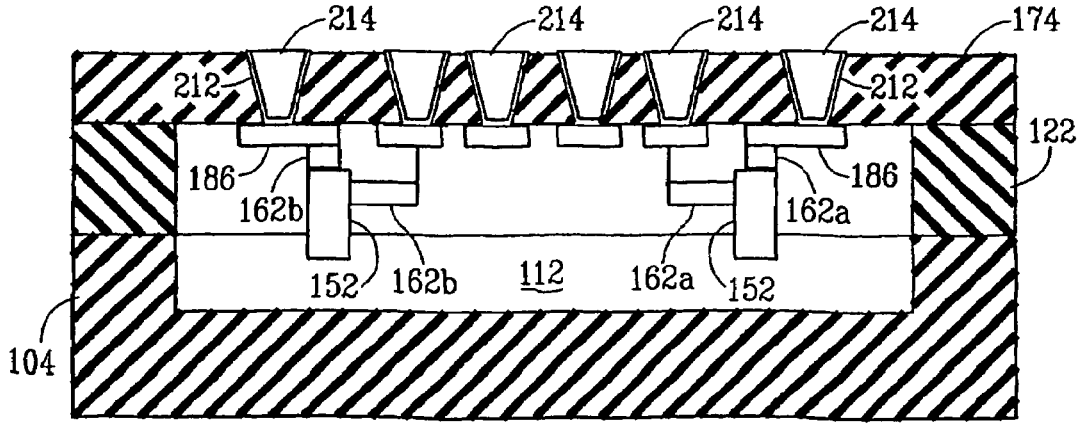
FIG. 16 is a cross-sectional, elevational view taken along the line 16—16 in FIG. 15 illustrating several vias formed through the glass substrate that effect an electrical connection to contact and grounding pads included in the MEMS switch.

Another alternative technique for providing the required electrical connections follows, with two main differences, the same procedure for fabricating the MEMS switch as that set forth above through thinning the base wafer 104 and the glass substrate 174 depicted in FIG. 10. The first difference is that the cavities 112 and 116 depicted in FIG. 3 are not required for electrical contact pads, but are only necessary for the grounding islands 152 and the cantilevers 166. In this alternative embodiment the contact and grounding pads will be located on the outer layer of the glass substrate 174. The second difference is that the metal pattern will differ form the preferred embodiment to optimize RF performance utilizing two layers of metal interconnects, on each side of the glass wafer. After thinning the glass substrate 174 to a thickness of approximately 50 microns, as depicted in FIGS. 15 and 16 vias 212 are etched through the glass substrate 174 to the Cr seed layer of contact pads, grounding pads and electrodes. The Cr seed layer was deposited in forming the metal structures depicted in FIG. 9. The glass is typically wet etched using an isotropic etchant such as 8:1 $HNO_3$:HF. The etchant will stop on reaching the Cr layer. After the metal forming the contact pads, grounding pads and electrodes has been exposed, metal 214 is deposited into the vias 212 and over the surface of the glass substrate 174 thereby extending the metal of the contact pads, grounding pads and electrodes to the outer surface of the glass substrate 174. The metal 214 is a sputtered or evaporated film of chrome-gold (Cr—Au) similar to that deposited on the glass substrate 174 in forming the metal structures depicted in FIG. 9. The deposited Cr—Au film is patterned and etched leaving bonding pad areas adjacent and connected to the metal 214 deposited into each of the. Subsequently, additional Au is plated on the metal for a total thickness of approximately 4.0 microns. The bonding pad areas of the metal 214 may then be connected to a printed circuit board either by wires bonded to the metal 214 or by solder bumps. RIE etching of the base wafer 104 to open cavities 112 and 116 as illustrated in FIG. 11 is no longer necessary since the bonding pad areas are provided on the external surface of the glass substrate 174. Therefore the backside patterning and etching of the base wafer 104 needed for RIE etching to open the cavities 112 and 116 is omitted in this alternative embodiment. One advantage provided by this particular alternative technique for forming electrical connections to the switch contacts 56*a*1, 56*a*2, 56*b*1 and 56*b*2, electrodes 54*a* and 54*b*, and ground plates 162*a* and 162*b* is that the resulting MEMS switch is hermetically sealed.

Figure 17:
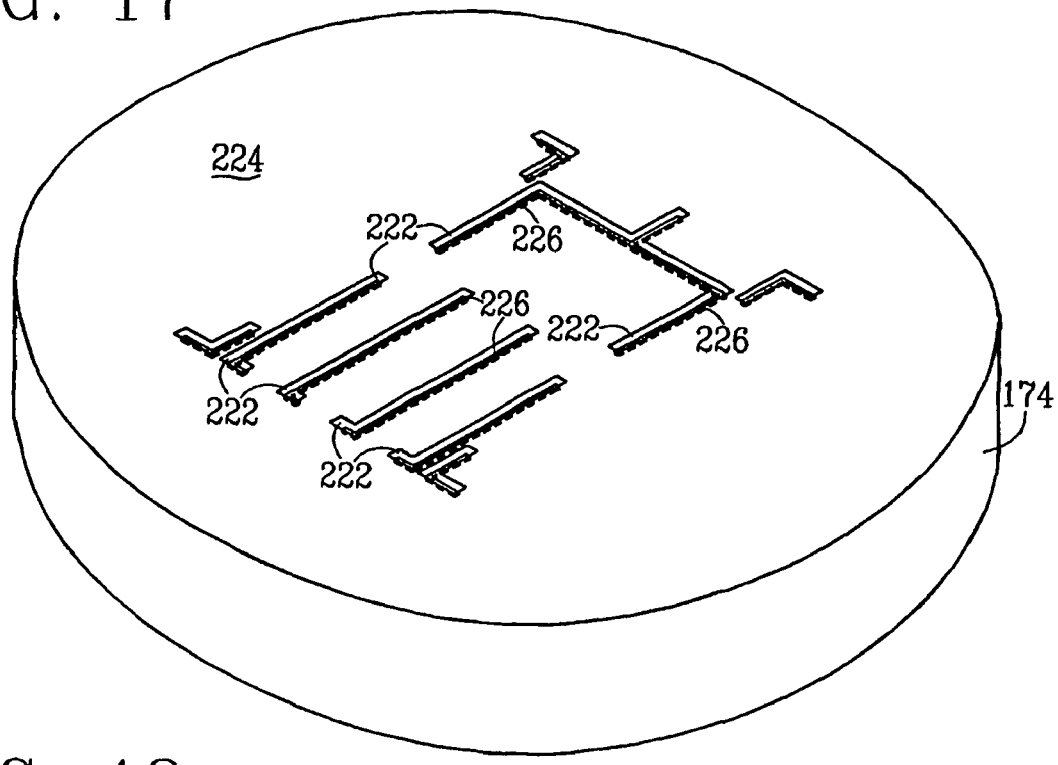
FIG. 17 is a perspective view of a portion of an alternative embodiment glass substrate which illustrates micro-machined channels which hold electrical conductors.

FIGS. 17 through 20 depict a final alternative embodiment which also produces a hermetically sealed MEMS switch. In this alternative embodiment, first a pattern of channels 222 are etched approximately 50 microns deep into a surface 224 of the glass substrate 174 as depicted in FIG. 17. A seed layer of Cr—Au is then deposited onto the surface 224 and patterned to permit subsequently forming Au conductors 226 in each of the channels 222 which are approximately 4.0 microns thick. The Au conductors 226 carry the electrical signals from the switch structures, i.e. the switch contacts 56*a*1, 56*a*2, 56*b*1 and 56*b*2, electrodes 54*a* and 54*b* and ground plates 162*a* and 162*b*, within the hermetically sealed part of the MEMS switch to bonding pads 248 that are outside the sealed portion of the MEMS switch.

Figure 18:
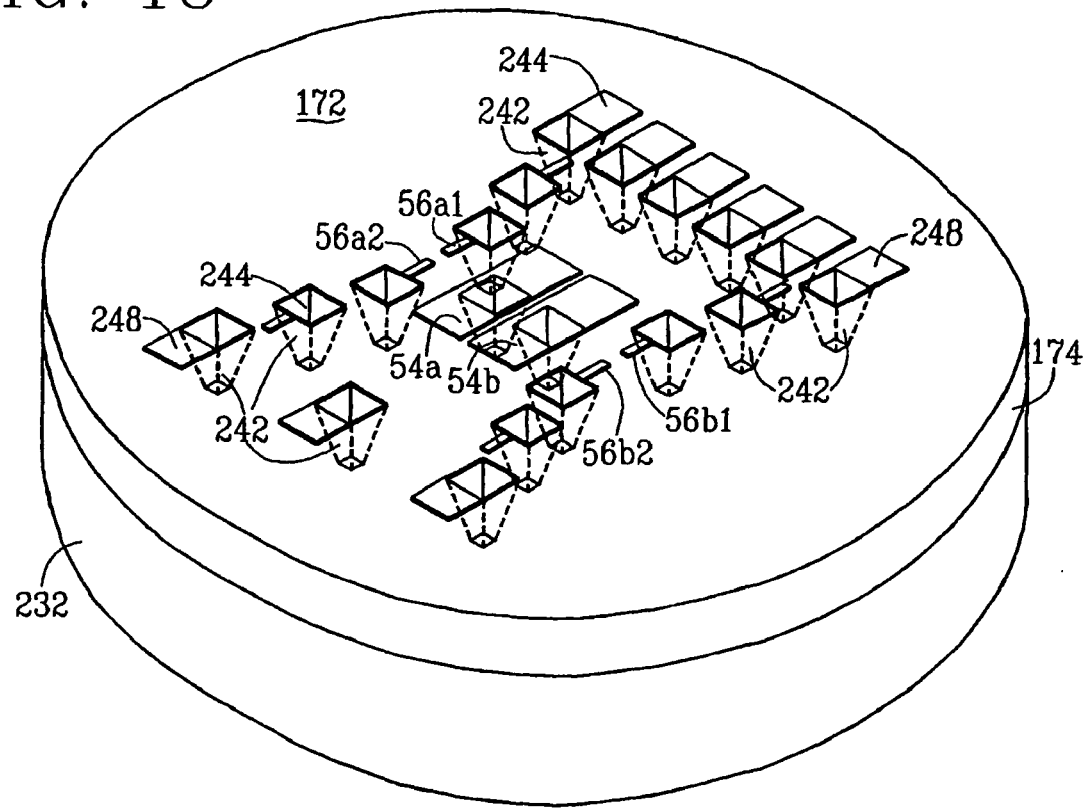
FIG. 18 is a perspective view of a portion of the alternative embodiment glass substrate depicted in FIG. 17 with the channels and electrical conductors juxtaposed with a support wafer to which the glass substrate has been anodically bonded to permit forming electrically conductive vias through the glass substrate.

As depicted in FIG. 18, the surface 224 of the glass substrate 174 is then anodically bonded to a conventional silicon support wafer 232, and the glass substrate 174 thinned to 100 microns. Similar to the process described above for the alternative embodiment depicted in FIGS. 15 and 16, vias 242 are then etched through the glass substrate 174 to the Cr seed layer of the conductors 226. The glass is typically wet etched using an isotropic etchant such as 8:1 $HNO_3$:HF. The etchant will stop on reaching the Cr layer. After the Cr layer of the conductors 226 has been exposed, metal 244 is deposited into the vias 242 and over the metalization surface 172 of the glass substrate 174 thereby extending the metal of the conductors 226 to the metalization surface 172 of the glass substrate 174. The metal 244 is a sputtered or evaporated film of chrome-gold (Cr—Au) similar to that deposited on the glass substrate 174 in forming the metal structures depicted in FIG. 9. The deposited Cr—Au film is patterned and etched to form the electrodes 54*a* and 54*b*, the switch contacts 56*a*1, 56*a*2, 56*b*1 and 56*b*2, contacts for the ground plates 162*a* and 162*b* atop the grounding islands 152 as well as bonding pads 248. Subsequently, additional Au is plated on the metal for a total thickness of approximately 4.0 microns.

Figure 19:
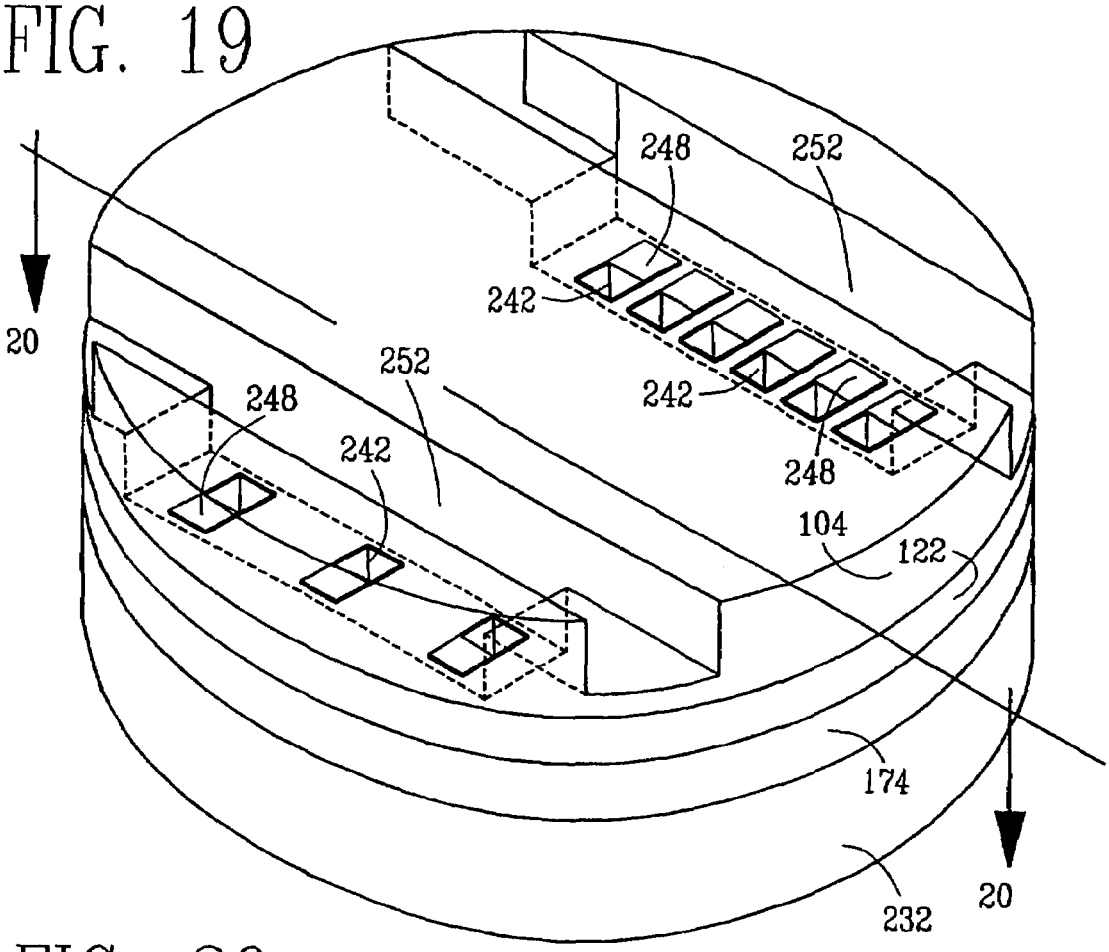
FIG. 19 is a perspective view of portions of the base wafer and the device layer of the SOI wafer similar to that depicted in FIG. 7 and the glass substrate and support wafer depicted in FIG. 18 after the metallic structures, including electrically conductive vias, have been mated with the micro-machined surface of the device layer, and the device layer has been anodically bonded to the glass substrate.

The metalization surface 172 of the glass substrate 174 is then anodically bonded to the front surface 142 of the device layer 122 as illustrated in FIG. 19 so the bonding pads 248 become isolated from the remainder of the MEMS switch in bonding pad cavities 252. The cavities 252, which are located immediately adjacent to where saw cuts will subsequently individualize the MEMs switches, are formed into the base wafer 104 concurrently with micro-machining the cavities 112, 114 and 116 depicted in FIG. 6, and through the device layer 122 concurrently with micro-machining the initial cavity 144 in FIG. 6 and then freeing the seesaw 52 in FIG. 7. The major difference in forming the initial cavity 144 between the preferred embodiment of the MEMS switch and this embodiment is that the initial cavity 144 is now separated into three (3) distinct cavities corresponding to the cavities 112, 114 and 116 depicted in FIG. 3. The walls 154 and 156 which have openings in the preferred embodiment as depicted in FIG. 6 are now continuous, thus separating the initial cavity 144 into three separate cavities. The now buried conductors 226 carry the electrical signals under the walls 154 and 156. Then, similar to the alternative embodiment illustrated in FIGS. 13 and 14, saw cuts 204 are made in the base wafer 104 along rows of the cavities 252 thereby exposing the bonding pads 248 isolated therein. Subsequent sawing completely through the combined base wafer 104, device layer 122, glass substrate 174 and support wafer 232 yields the individual MEMS switches.

Figure 20:
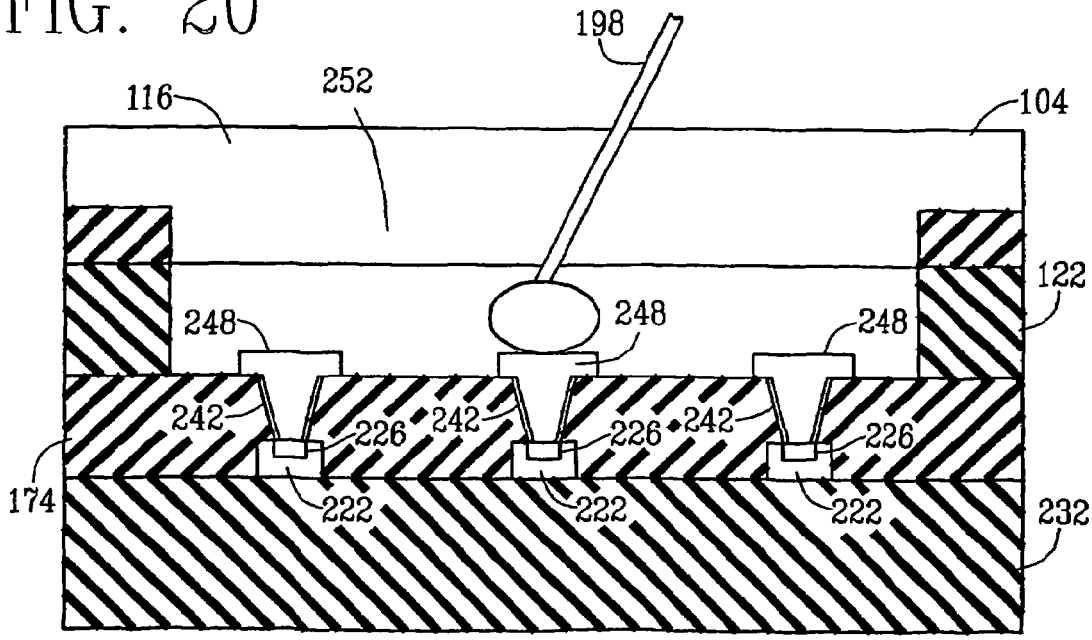
FIG. 20 is a cross-sectional, elevational view taken along the line 20—20 in FIG. 19 illustrating several vias formed through the glass substrate that effect an electrical connection to bonding pads included in the MEMS switch.

FIG. 20 depicts one cavity 252 with bonding pads 248 located therein, vias 242 passing through the glass substrate 174, and the conductors 226 within the channels 222. The illustration of FIG. 20 also shows an electrical lead 198 wire bonded to one of the bonding pads 248. Alternatively, solder bumps may be formed on the bonding pads 248.

INDUSTRIAL APPLICABILITY

Although the present invention has been described in terms of the presently preferred embodiment, it is to be understood that such disclosure is purely illustrative and is not to be interpreted as limiting. For example, while a single crystal silicon layer for forming the seesaw 52 is preferably the device layer of a SOI wafer, it may also be an N-type top layer of epi on an epi wafer. While material of the device layer 122 to which ends of the torsion bars 66*a* and 66*b* furthest from the seesaw 52 are coupled forms a frame which preferably surrounds the seesaw 52, the seesaw 52 of a MEMS switch in accordance with the present invention need not be surrounded by material of the device layer 122. While metallic conductors included in the MEMS switch are preferably gold (AU) applied to a Titanium (Ti) adhesion layer, they could be made using any number of other material combinations such as platinum (Pt) on titanium (Ti) or tungsten (W). The metals may be applied by any of the common deposition methods used in semiconductor processing, which include sputtering, e-beam deposition and evaporation.

There also exists an alternative to using electrical leads 198 connected to contact pads and grounding pads 186 for coupling signals into and out of the MEMS switch. Because the base wafer 104 can be thinned to a thickness of less than 100 microns, electrical signals can alternatively be coupled into and out of the MEMS switch using solder bumps formed on the contact pads and grounding pads 186. The presence of solder bumps on the contact pads and the grounding pads 186 permits flip-chip attachment of the MEMS switch to mating solder bumps present on a printed circuit board.

Similarly, while the preferred embodiment MEMS switch disclosed herein is a single-pole double-throw ("SPDT") switch, it may be readily adapted for construction as two, mutually exclusive single-pole single-throw ("SPST") switches. These two mutually exclusive SPST switches may then configured to operate as a SPDT switch by properly connected wiring that is outside the MEMs switch. Furthermore, instead of the switch contacts 56*a*1, 56*a*2, 56*b*1 and 56*b*2 and the two shorting bars 58*a* and 58*b*, a SPDT MEMS switch in accordance with the present invention may be constructed with only the switch contacts 56*a*1 and 56*b*1 and with the two shorting bars 58*a* and 58*b* being electrically connected to each other by a conductor that is located on the seesaw 52. In such a configuration for the MEMS switch, the conductor which electrically couples together the two shorting bars 58*a* and 58*b* on the seesaw 52 connects to the common terminal 182 by an extension thereof which traverses one of the torsion bars 66*a* and 66*b*.

Moreover, more than one seesaw 52 together with its associated electrodes 54*a* and 54*b* and switch contacts 56*a*1, 56*a*2, 56*b*1 and 56*b*2 may be incorporated in a single MEMS switch in accordance with the present invention. Using two seesaws 52 with their associated electrodes 54*a* and 54*b* and switch contacts 56*a*1, 56*a*2, 56*b*1 and 56*b*2 it is possible to provide a single-pole four-throw (SP4T) MEMS switch. While external wiring may configure a MEMs switch in accordance with the present invention to operate as a shunt switch, the MEMS switch itself can be configured to operate as a shunt switch by connecting the shorting bars 58*a* and 58*b* to ground. In such a shunt switch, the switch contacts 56*a*1, 56*a*2, 56*b*1 and 56*b*2 could be a continuous conductor lacking the gap appearing therein FIGS. 1 and 9.

Consequently, without departing from the spirit and scope of the invention, various alterations, modifications, and/or alternative applications of the invention will, no doubt, be suggested to those skilled in the art after having read the preceding disclosure. Accordingly, it is intended that the following claims be interpreted as encompassing all alterations, modifications, or alternative applications as fall within the true spirit and scope of the invention.

What is claimed is:

1. An integral micro-electro mechanical systems ("MEMS") switch adapted for selectively coupling an electrical signal present on a first input conductor connected to the MEMS switch to a first output conductor also connected to the MEMS switch, the MEMS switch comprising:

a. a monolithic layer of material having micro-machined therein:

i. a seesaw;

ii. a pair of torsion bars that are disposed on opposite sides of and coupled to the seesaw, and which establish an axis about which the seesaw is rotatable; and iii. a frame to which ends of the torsion bars furthest from the seesaw are coupled, the frame supporting through the torsion bars the seesaw for rotation about the axis established by the torsion bars;

iv. an electrically conductive first shorting bar carried at an end of the seesaw distal from the rotation axis established by the torsion bars;

b. a base that is joined to a first surface of the monolithic layer;

c. a substrate that is bonded to a second surface of the monolithic layer which is distal from the first surface thereof to which the base is joined, the substrate having formed thereon:

i. a first electrode which is juxtaposed with a surface of the seesaw that is located to one side of the rotation axis established by the torsion bars, application of an electrical potential between the first electrode and the seesaw urging the seesaw to rotate in a first direction about the rotation axis established by the torsion bars;

ii. a first pair of switch contacts adapted to be connectable respectively to the first input conductor and to the first output conductor, and which:

(1) are disposed adjacent to but spaced apart from the first shorting bar when no force is applied to the seesaw;

(2) when no force is applied to the seesaw are electrically insulated from each other;

(3) the first shorting bar contacts upon application of a sufficiently strong force to the seesaw which urges the seesaw to rotate in the first direction about the rotation axis established by the torsion bars; and (4) first electrical conductors that respectively carry electrical signals between the switch contacts and the first input and first output conductors; and d. a first ground plate which is disposed adjacent to and is electrically insulated from the first electrical conductors;

whereby upon rotation of the seesaw about the rotation axis established by the torsion bars in the first direction to such an extent that the first shorting bar contacts the first pair of switch contacts, the contacting first shorting bar electrically couples together the first pair of switch contacts.

2. The MEMS switch of claim 1 that is further adapted for selectively coupling an electrical signal present on a second input conductor connected to the MEMS switch to a second output conductor also connected to the MEMS switch:

wherein the seesaw carries a second shorting bar at an end of the seesaw that is located on an opposite side of the rotation axis from the first shorting bar; and wherein the substrate also has formed thereon:

iii. a second pair of switch contacts adapted to be connectable respectively to the second input conductor and to the second output conductor, and which:

(1) are disposed adjacent to but spaced apart from the second shorting bar when no force is applied to the seesaw;

(2) when no force is applied to the seesaw are electrically insulated from each other;

(3) the second shorting bar contacts upon application of a sufficiently strong force to the seesaw which urges the seesaw to rotate in a second direction about the rotation axis established by the torsion bars that is opposite to the first direction; and (4) second electrical conductors that respectively carry electrical signals between the switch contacts and the second input and second output conductors; and e. a second ground plate which is disposed adjacent to and is electrically insulated from the second electrical conductors;

whereby upon rotation of the seesaw about the rotation axis established by the torsion bars in the second direction to such an extent that the second shorting bar contacts the second pair of switch contacts, the contacting second shorting bar electrically couples together the second pair of switch contacts.

3. The MEMS switch of claim 2 wherein the substrate also has formed thereon a second electrode which is juxtaposed with a surface of the seesaw that is located to one side of the rotation axis established by the torsion bars which is opposite to the surface of the seesaw with which the first electrode is juxtaposed, application of an electrical potential between the second electrode and the seesaw urging the seesaw to rotate in the second direction about the rotation axis established by the torsion bars.

4. The MEMS switch of claim 1 that is further adapted for selectively coupling an electrical signal present on a second input conductor connected to the MEMS switch to the first output conductor:

wherein the seesaw carries a second shorting bar at an end of the seesaw that is located on an opposite side of the rotation axis from the first shorting bar; and wherein the substrate also has formed thereon:

iii. a second pair of switch contacts a first one of which is adapted to be connectable respectively to the second input conductor and a second one of which is connected to that one of the second pair of switch contacts which is adapted to be connectable to the first output conductor, and which:

(1) are disposed adjacent to but spaced apart from the second shorting bar when no force is applied to the seesaw;

(2) when no force is applied to the seesaw are electrically insulated from each other;

(3) the second shorting bar contacts upon application of a sufficiently strong force to the seesaw which urges the seesaw to rotate in a second direction about the rotation axis established by the torsion bars that is opposite to the first direction; and (4) second electrical conductors that respectively carry electrical signals between the switch contacts and the second input and first output conductors; and e. a second ground plate which is disposed adjacent to and is electrically insulated from the second electrical conductors;

whereby upon rotation of the seesaw about the rotation axis established by the torsion bars in the second direction to such an extent that the second shorting bar contacts the second pair of switch contacts, the contacting second shorting bar electrically couples together the second pair of switch contacts.

5. The MEMS switch of claim 4 wherein the substrate also has formed thereon a second electrode which is juxtaposed with a surface of the seesaw that is located to one side of the rotation axis established by the torsion bars which is opposite to the surface of the seesaw with which the first electrode is juxtaposed, application of an electrical potential between the second electrode and the seesaw urging the seesaw to rotate in the second direction about the rotation axis established by the torsion bars.

6. The MEMS switch of claim 1 wherein a fusion bond joins the monolithic layer and the base.

7. The MEMS switch of claim 1 wherein material forming the monolithic layer is single crystal silicon (Si).

8. The MEMS switch of claim 1 wherein a sheet of electrically insulating material is interposed between the seesaw and shorting bar.

9. The MEMS switch of claim 1 wherein the base includes a cavity formed therein which abuts the first surface of the monolithic layer, and into which a portion of the seesaw enters upon rotation of the seesaw about the axis established by the torsion bars.

10. The MEMS switch of claim 1 wherein the ground plate is disposed on the monolithic layer.

11. The MEMS switch of claim 10 wherein the monolithic layer includes a cantilever which supports at a free end thereof a grounding island which at an end thereof which is distal from the cantilever carries a portion of the ground plate, the portion of the ground plate at the end of the grounding island being continuously urged by force supplied by the cantilever into an unswitched, intimate contact with an electrical conductor that is disposed on the substrate.

12. A micro-electro mechanical systems ("MEMS") structure comprising:

a first layer having disposed thereon an electrical conductor; and a second layer also having disposed thereon an electrical conductor, the second layer including:

a. a cantilever; and b. an electrical contact island which is supported at a free end of the cantilever, the electrical contact island at an end thereof which is distal from the cantilever carrying a portion of the electrical conductor that is disposed on the second layer, the portion of the electrical conductor at the end of the electrical contact island being continuously urged by force supplied by the cantilever into an unswitched intimate contact with the electrical conductor that is disposed on the first layer.

13. A micro-electro mechanical systems ("MEMS") electrical contact structure adapted for forming an unswitched electrical contact between an electrical conductor that is disposed on a first layer of a MEMS device and an electrical conductor that is disposed on a second layer of the MEMS device, the MEMS electrical contact structure comprising:

a cantilever included in the second layer; and an electrical, contact island also included in the second layer which is supported at a free end of the cantilever, the electrical contact island at an end thereof which is distal from the cantilever carrying a portion of the electrical conductor that is disposed on the second layer, the portion of the electrical conductor at the end of the electrical contact island being continuously urged by force supplied by the cantilever into an unswitched intimate contact with the electrical conductor that is disposed on the first layer.

14. An integral micro-electro mechanical systems ("MEMS") switch adapted for selectively coupling an electrical signal present on a first input conductor connected to the MEMS switch to a first output conductor also connected to the MEMS switch, the MEMS switch comprising:

a. a monolithic layer of material having micro-machined thereon a moveable electrically conductive first shorting bar that is disposable in at least two (2) alternative positions;

b. a base that is joined to a first surface of the monolithic layer;

c. a substrate that is bonded to a second surface of the monolithic layer which is distal from the first surface thereof to which the base is joined, the substrate having formed thereon a first pair of switch contacts which:

i. are disposed adjacent to but spaced apart from the first shorting bar when the first shorting bar is disposed in a first position;

ii. are electrically insulated from each other when the first shorting bar is disposed in the first position;

iii. the first shorting bar contacts when the first shorting bar is disposed in a second position; and iv. connect to a pair of first electrical conductors that are respectively adapted for conducting an electrical signal between the first pair of switch contacts and the first input and first output conductors; and d. a first ground plate which is disposed adjacent to and is electrically insulated from both:

i. the first pair of switch contacts; and ii. the first electrical conductors;

whereby movement of the first shorting bar from the first position to the second position establishes an electrical connection between the first shorting bar and the first pair of switch contacts thereby electrically coupling together the first pair of switch contacts while the first ground plate remains separated from but in close proximity to both:

a. the first pair of switch contacts; and b. the first electrical conductors.

15. The MEMS switch of claim 14 wherein a sheet of electrically insulating material is interposed between the monolithic layer and shorting bar.

16. The MEMS switch of claim 14 that is further adapted for selectively coupling an electrical signal present on a second input conductor connected to the MEMS switch to a second output conductor also connected to the MEMS switch:

wherein the monolithic layer carries a second moveable electrically conductive shorting bar that is disposable in at least two (2) alternative positions; and wherein the substrate also has formed thereon a second pair of switch contacts which:

i. are disposed adjacent to but spaced apart from the second shorting bar when the second shorting bar is disposed in a first position;

ii. are electrically insulated from each other when the second shorting bar is disposed in the first position;

iii. the second shorting bar contacts when the second shorting bar is disposed in a second position; and iv. connect to a pair of second electrical conductors that are respectively adapted for conducting an electrical signal between the second pair of switch contacts and the second input and second output conductors; and e. a second ground plate which is disposed adjacent to and is electrically insulated from both:

i. the second pair of switch contacts; and ii. the second electrical conductors;

whereby movement of the second shorting bar from the first position to the second position establishes an electrical connection between the second shorting bar and the second pair of switch contacts thereby electrically coupling together the second pair of switch contacts while the second ground plate remains separated from but in close proximity to both:

a. the second pair of switch contacts; and b. the second electrical conductors.

17. The MEMS switch of claim 16 wherein the second shorting bar moves from the first position to the second position synchronously with movement of the first shorting bar from the second position to the first position.

18. The MEMS switch of claim 14 that is further adapted for selectively coupling an electrical signal present on a second input conductor connected to the MEMS switch to the first output conductor:

wherein the monolithic layer carries a second moveable electrically conductive shorting bar that is disposable in at least two (2) alternative positions; and wherein the substrate also has formed thereon a second pair of switch contacts which:

i. are disposed adjacent to but spaced apart from the second shorting bar when the second shorting bar is disposed in a first position;

ii. are electrically insulated from each other when the second shorting bar is disposed in the first position;

iii. the second shorting bar contacts when the second shorting bar is disposed in a second position; and iv. connect to a pair of second electrical conductors that are respectively adapted for conducting an electrical signal between the second pair of switch contacts and the second input conductor and the first output conductor; and e. a second ground plate which is disposed adjacent to and is electrically insulated from both:

i. the second pair of switch contacts; and ii. the second electrical conductor;

whereby movement of the second shorting bar from the first position to the second position establishes an electrical connection between the second shorting bar and the second pair of switch contacts thereby electrically coupling together the second pair of switch contacts while the second ground plate remains separated from but in close proximity to both:

a. the second pair of switch contacts; and b. the second electrical conductor.

19. The MEMS switch of claim 18 wherein the second shorting bar moves from the first position to the second position synchronously with movement of the first shorting bar from the second position to the first position.

20. The MEMS switch of claim 14 wherein a fusion bond joins the monolithic layer and the base.

21. The MEMS switch of claim 14 wherein material forming the monolithic layer is single crystal silicon (Si).

22. The MEMS switch of claim 14 wherein the ground plate is disposed on the monolithic layer.

23. The MEMS switch of claim 22 wherein the monolithic layer includes a cantilever which supports at a free end thereof a grounding island which at an end thereof which is distal from the cantilever carries a portion of the ground plate, the portion of the ground plate at the end of the grounding island being continuously urged by force supplied by the cantilever into an unswitched, intimate contact with an electrical conductor that is disposed on the substrate.

* * * * *